US006842583B1

(12) United States Patent
Weber et al.

(10) Patent No.: US 6,842,583 B1
(45) Date of Patent: Jan. 11, 2005

(54) METHODS FOR SIMULATING ACTION PHOTOGRAPHS AND FILMS

(76) Inventors: Mark Owen Weber, P.O. Box 1553, South Lake Tahoe, CA (US) 96156; Deanna May Weber, P.O. Box 1553, South Lake Tahoe, CA (US) 96156

( * ) Notice: Subject to any disclaimer, the term of this patent is extended or adjusted under 35 U.S.C. 154(b) by 141 days.

(21) Appl. No.: 10/249,739

(22) Filed: May 5, 2003

(51) Int. Cl.[7] ..... G03B 15/00; A63G 31/00; A63J 5/02

(52) U.S. Cl. ..... 396/3; 396/5; 472/57

(58) Field of Search ..... 396/1, 3, 5; 472/57, 472/68, 70, 75, 80

(56) References Cited

U.S. PATENT DOCUMENTS

| | | | | | |
|---|---|---|---|---|---|
| 259,573 | A | * | 6/1882 | Morhiser | 396/3 |
| 361,893 | A | | 4/1887 | Mestayer et al. | |
| 838,979 | A | | 12/1906 | Goldin | |
| 2,487,140 | A | | 11/1949 | Karson | |
| 2,646,735 | A | * | 7/1953 | Brunnen | 108/4 |
| 3,950,776 | A | | 4/1976 | Corrigan | |
| 3,967,301 | A | * | 6/1976 | Corning | 396/3 |
| 4,244,566 | A | | 1/1981 | Molovinsky | |
| 5,486,001 | A | * | 1/1996 | Baker | 473/266 |
| 5,833,544 | A | * | 11/1998 | Corbin et al. | 472/57 |
| 6,068,559 | A | * | 5/2000 | Lubell et al. | 473/266 |

* cited by examiner

*Primary Examiner*—Christopher Mahoney
(74) *Attorney, Agent, or Firm*—Ronald E. Smith; Smith & Hopen, P.A.

(57) ABSTRACT

A method of photographing a simulated activity includes a stable photographic platform that enables an individual to safely mount an item of equipment or a safety surface adjacent the item of equipment so that a photograph may be taken. The item of equipment may be positioned in concealing relation to a structure that supports the item of equipment or the safety surface. The posing individual or the clothing of the posing individual may also conceal the support structure. Alternatively, the support structure and the safety surface may be unconcealed but disguised as a natural element of a photographed scene, such as a rail in a skateboard park. The result is a photograph of an activity where the individual and the equipment appear to be precariously positioned or even suspended in the air with no apparent support. No part of the equipment or individual is cropped from the photograph.

62 Claims, 17 Drawing Sheets

FIG. 3A
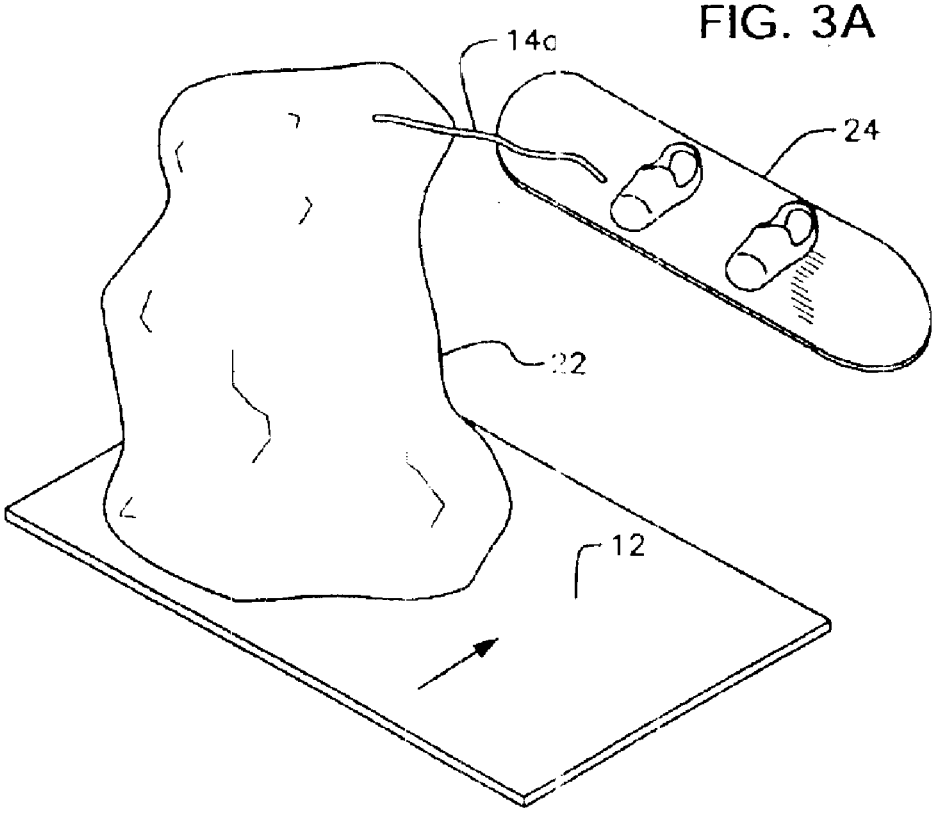
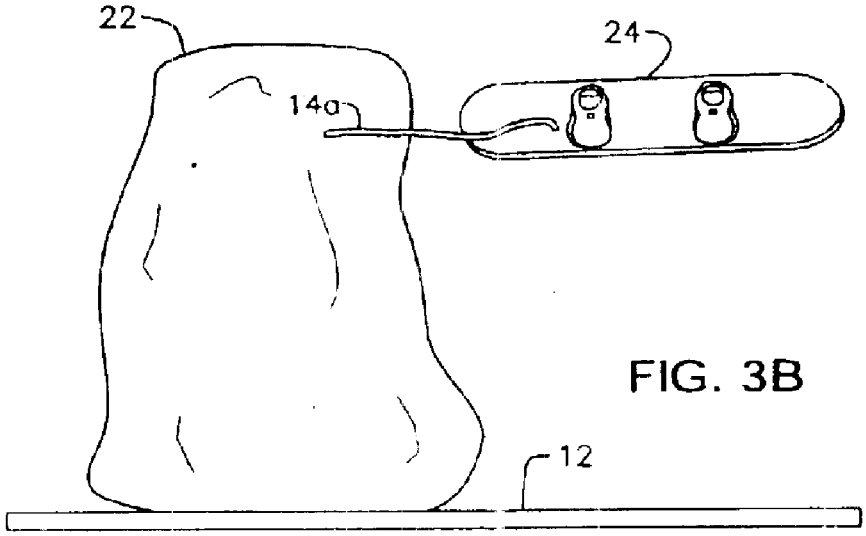
FIG. 3B

FIG. 6C
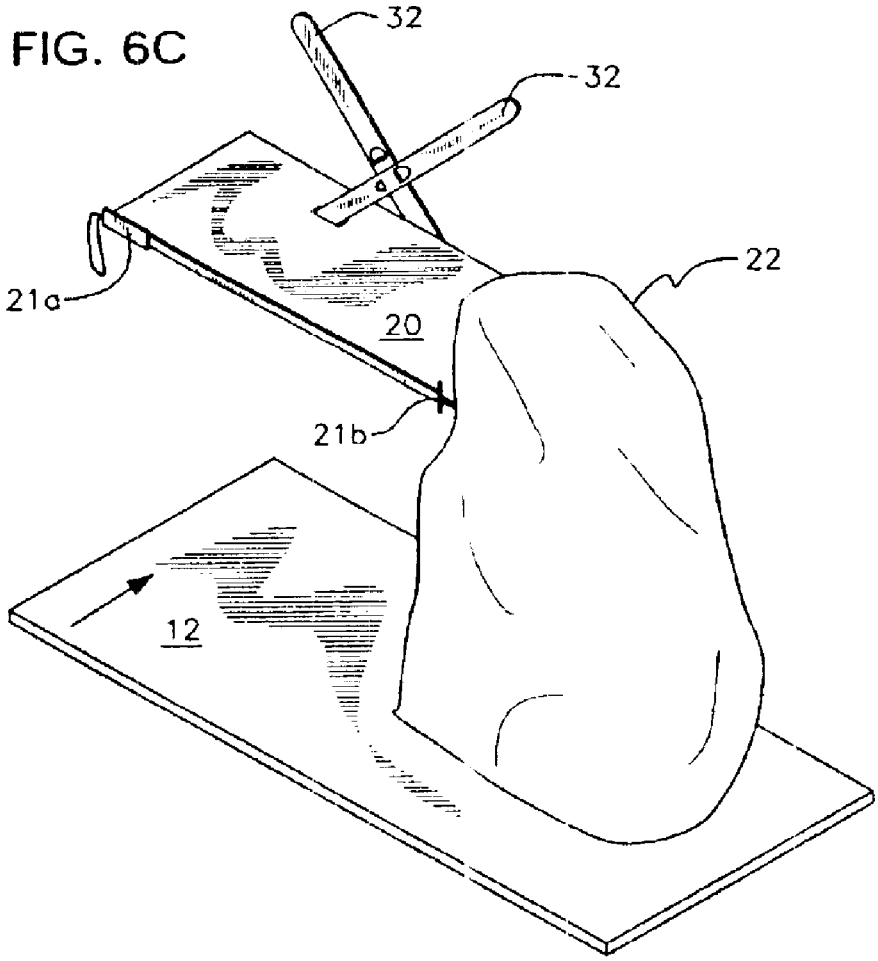
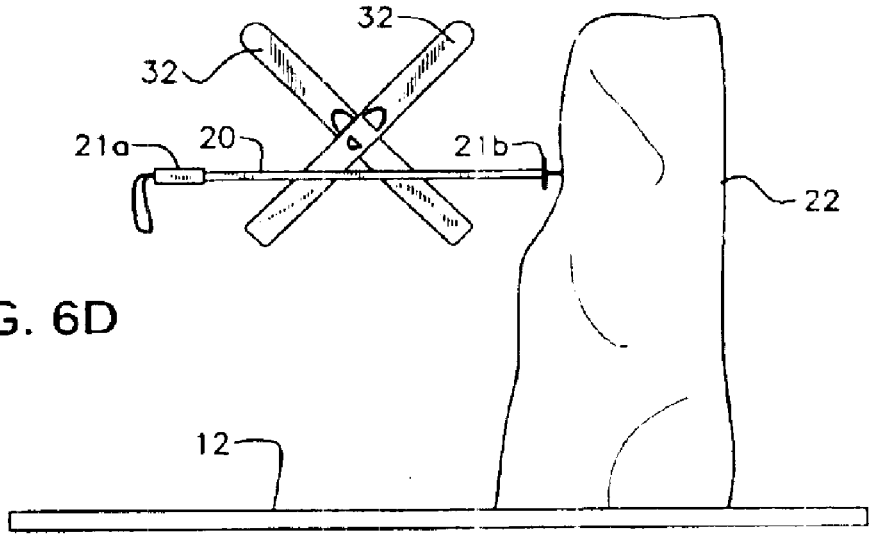
FIG. 6D

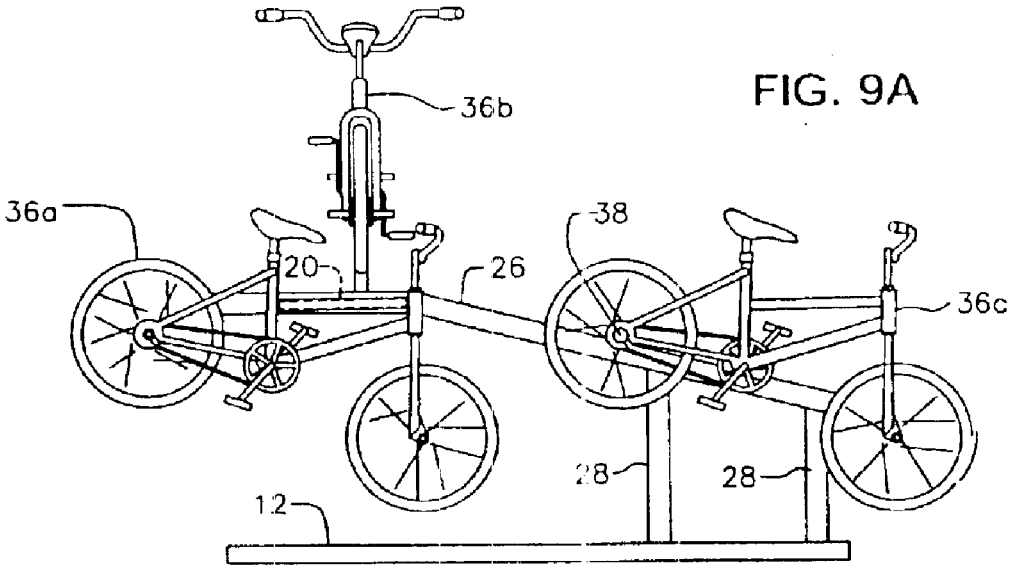
FIG. 9A
FIG. 9B
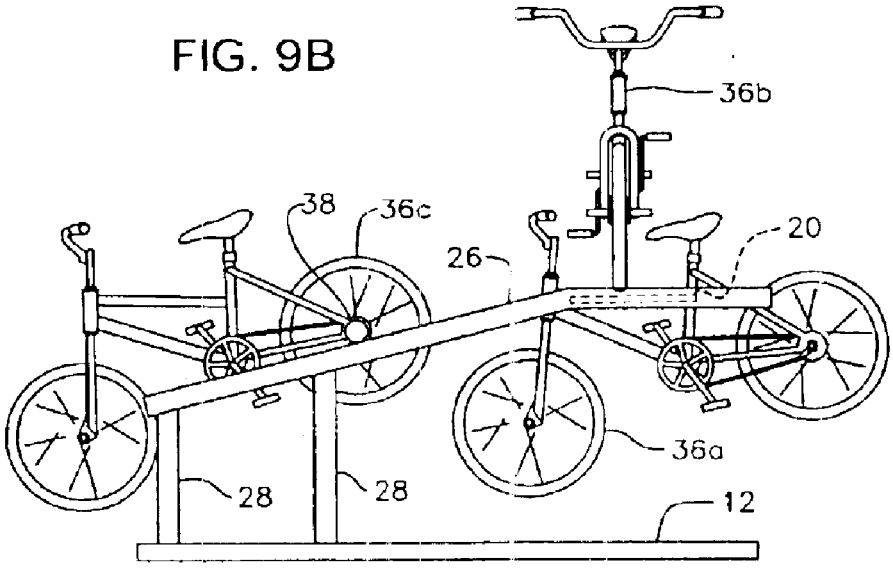

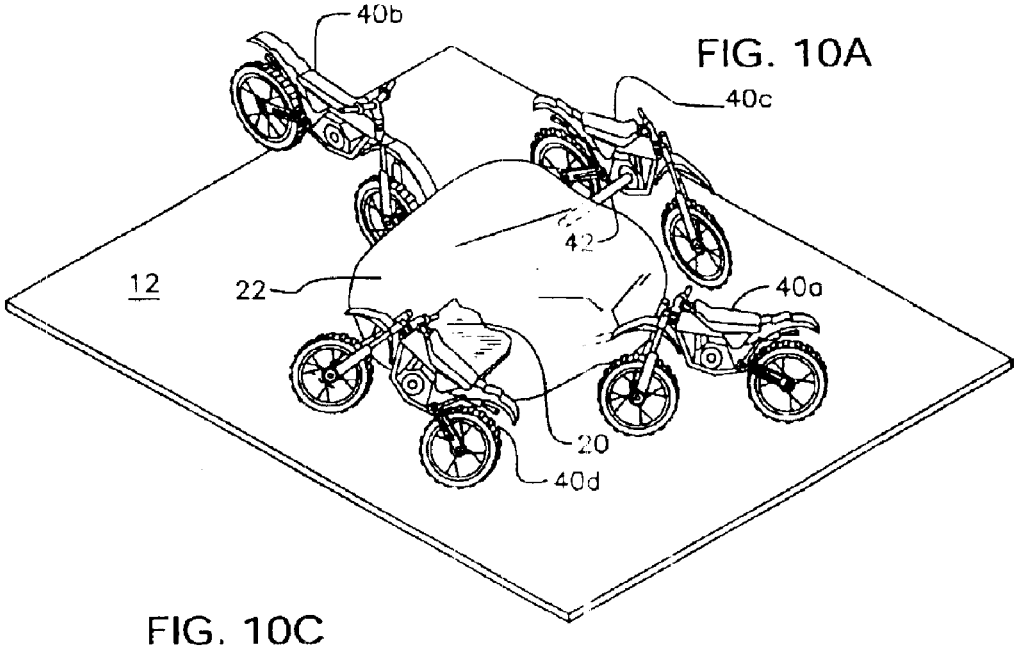
FIG. 10A
FIG. 10C
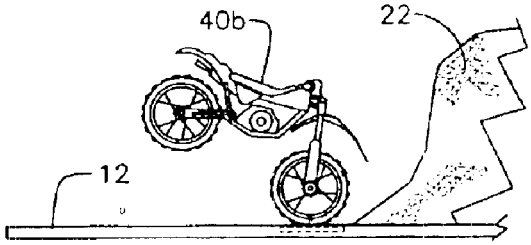
FIG. 10B
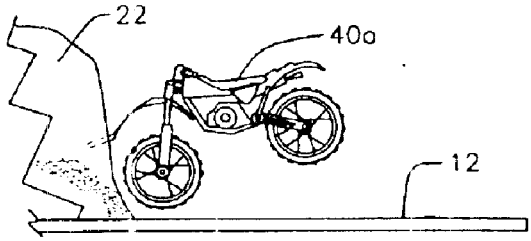

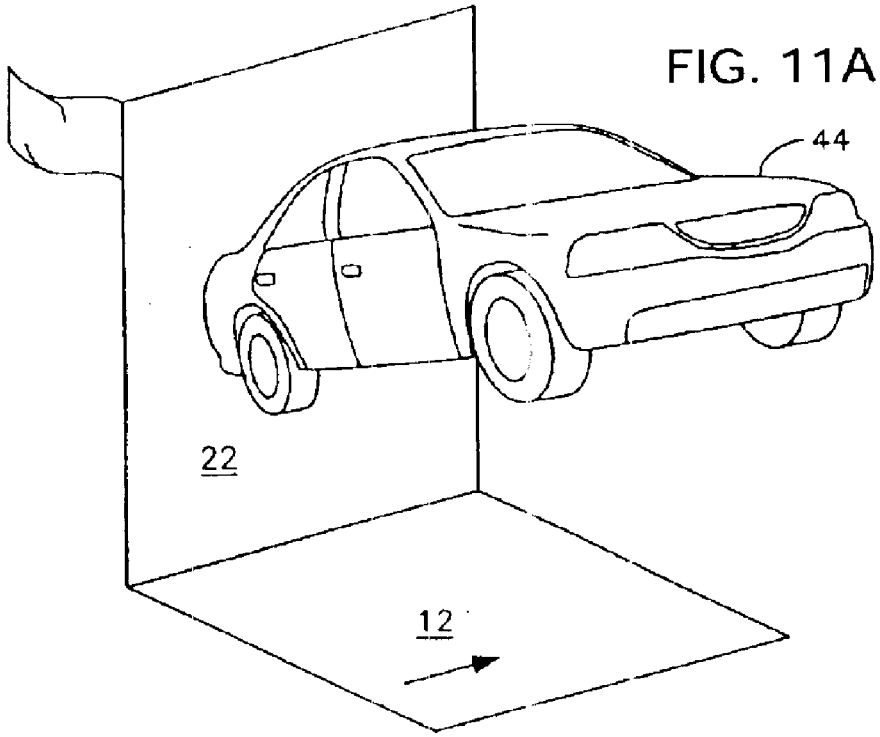
FIG. 11A
FIG. 11B
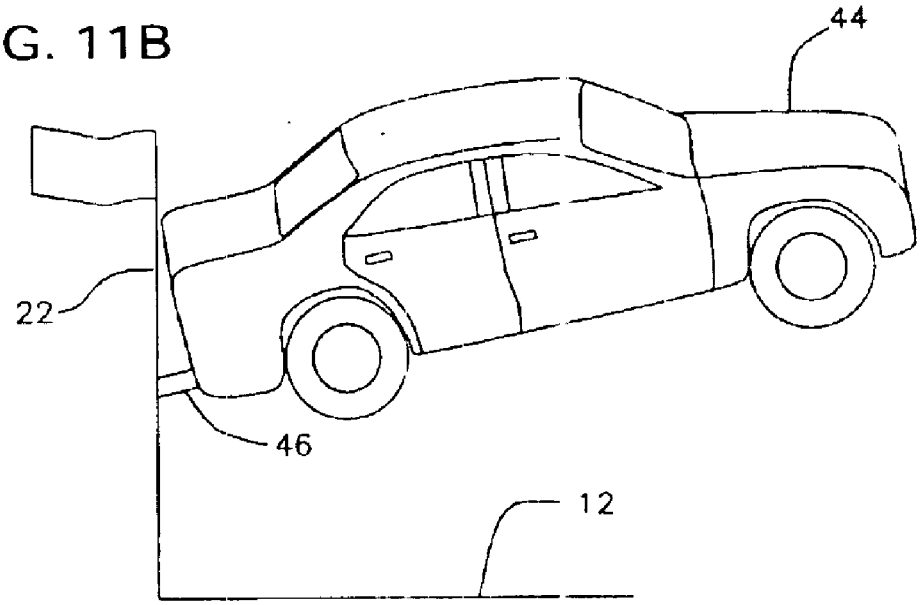

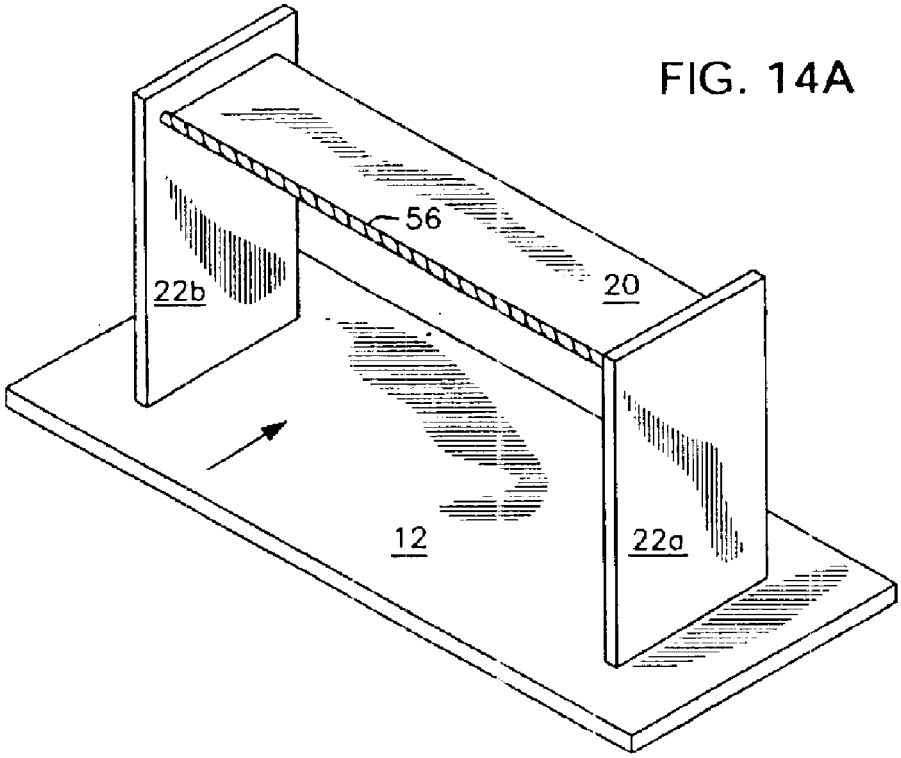
FIG. 14A
FIG. 14B
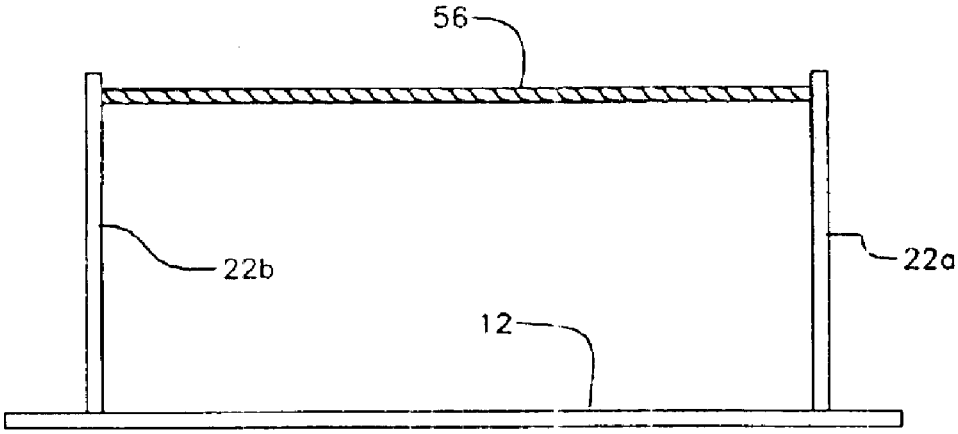

METHODS FOR SIMULATING ACTION PHOTOGRAPHS AND FILMS

BACKGROUND OF INVENTION

1. Field of the Invention

This invention relates, generally, to the art of photography and short motion pictures. More particularly, it relates to methods for creating an illusion that an individual is participating in an activity such as a conventional sport, an extreme sport, or an activity unrelated to a particular sport but which seems to require a high degree of physical training, strength, and skill.

2. Description of the Prior Art

Extreme sports are sports that involve a very high degree of athletic endeavor. As such, they are considered to be more extreme than traditional sports such as soccer, baseball, football, basketball, hockey, croquet, golfing, bowling, and the like. Sports often categorized as extreme sports include surfing, skating, skateboarding, snowboarding, wakeboarding, kiteboarding, acrobatic skiing, kayaking in white water, hang gliding, rock climbing, ice climbing, tightrope walking, stunt motorcycling, stunt bicycling, stunt snowmobiling, stunt automobile driving, and the like. This list is not exhaustive, there being many other sporting activities in the category of extreme sports.

Those who have the athletic ability to engage in extreme sports usually enjoy being photographed or filmed. Such recording enables them to share their exciting moments with friends who were not present to view the activity as it happened.

Many people enjoy the traditional sports as well and would also like to be photographed or filmed while enjoying such activity. Even non-athletes enjoy being photographed or filmed in the apparent performance of an unusual activity, even if the activity is unconnected to sports.

Activities of the type that would make a good photograph or a good short motion picture are often performed when an athlete is alone or in a spot that is difficult for a photographer or film-maker to reach. Although a professional photographer or film-maker can photograph or film virtually any activity anywhere, the athlete may not want to spend the funds required to retain a professional photographer or film-maker. Thus, a photographic subject often relies on friends to attempt to photograph or film him or her while engaged in a conventional or extreme sport, or a strenuous activity unrelated to sports, but the results are typically unsatisfactory. For example, it is difficult for an amateur photographer or film-maker to capture a dramatic moment in time such as a surfer or skier flying through the air when the subject is moving and the shooting environment is imperfect. It is also difficult to stage such a shot in a studio on dry land without resorting to cropping techniques where sporting equipment and the like are cropped from the picture.

Moreover, there are many people who lack the athleticism to actually perform a dramatic stunt of the type that would make a great photograph or short film. They may be good skateboarders, for example, but they may lack the skill to ride a rail down a long flight of stairs. Nonetheless, they would like a photograph or film of themselves performing an activity that they are unable to actually perform.

There are also many non-athletes who lack even the most basic skills yet would enjoy showing their friends photographs or films of themselves apparently performing an amazing stunt in an extreme sport or some other activity that may be unrelated to sports but which requires great athleticism, skill, or courage.

Photographers long ago developed obvious illusions such as an upstanding wall having painted thereon the body of a "muscle man" or a "bathing beauty" having no head so that a photographic subject could stand behind the wall and position his or her head where the muscle man's or bathing beauty's head would be to create the illusion that the subject is very muscular or shapely. Such well-known illusions suffer from the fact that they are obviously gags. No effort is made to actually create a photograph that convinces a viewer that a photographic subject really does possess an idealized physique.

U.S. Pat. No. 361,893 to Mestayer et al. discloses a toboggan having wheels and a braking mechanism that are hidden from the view of a theatrical audience when the toboggan, occupied by three actors, apparently slides down a hill side. The prop that serves as the hillside is positioned so that it conceals the wheels and the braking mechanism that are positioned below the plane of the surface upon which the actors sit while riding the apparent toboggan.

The Mestayer theatrical apparatus thus harnesses the principle of concealing parts that must remain unseen by an audience. However, the concealment means is not a naturally occurring element in a scene, like a rail in a skateboard park, a leash hanging from a surfboard, the tailpipe of a vehicle, and so on. Instead, it is just a wall with scenery painted thereon much like the "muscle man" cut outs mentioned above. Therefore, its presence is unnatural and its concealment function is clear to everyone in the audience. If a naturally-occurring concealment means is used, its function as a concealment means is not comprehended by viewers of the scene. Use of a naturally-occurring element in a scene as a concealment means is a teaching of the present invention, not of the prior art.

Moreover, the Mestayer audience never sees the entire toboggan. The rounded front end is visible, thereby suggesting that the vehicle is a toboggan, but a real toboggan is a sled so the wheels and braking mechanism of the simulated toboggan must remain concealed. Moreover, the apparent toboggan is seen in its ordinary, on-the-ground state. There is no suggestion in Mestayer as to how the toboggan could be fully exposed to view and posed in an apparent extreme action position, such as hurtling through the air at an angle.

It is worth observing again that the means for concealing the wheels and braking mechanism is a mere stage prop having little authenticity. When a concealment device is obviously used for concealment, the resulting photo or film is far from convincing. However, Mestayer neither teaches nor suggests the use of naturally appearing objects as concealment or support devices. The presence of a large rock, for example, in a scene where large rocks would be expected, enables such rock to serve as a support means, a concealment means, or both, without arousing suspicion in the minds of the viewers of the photo or short film.

A means for performing the classic stage illusion of a levitating individual is disclosed in U.S. Pat. No. 838,979 to Goldin. The body and clothing of the individual conceal a steel support upon which an individual reclines in a supine position and mechanical means for raising and lowering the steel support is concealed beneath a stage. An attendant of the magician stands in front of a post that is connected to the steel support and which is raised and lowered by the mechanism beneath the stage, thereby concealing the presence of the post.

The Goldin structure thus teaches that support structures may be concealed by a participant's body and clothing and by the positioning of an attendant. It is limited, however, in that the individual performing the apparent levitation must lie in a horizontal plane in a supine position and thus no action may be simulated.

Further, it is completely dependent upon the presence and positioning of additional persons, other than the individual performing the apparent levitation, to conceal the supports.

Moreover, since all supports are concealed, the levitating individual cannot react with any prop such as an item of sporting equipment or a generic, non-sporting item.

Nor is there a suggestion in Goldin that the concealment means could be something other than a human being nor is there a suggestion that a non-human concealment means could be disguised by placing it in full view as a naturally occurring part of a scene.

Another levitation device is disclosed in U.S. Pat. No. 4,244,566 to Molovinsky. It also relies upon a magician or an assistant standing in front of a post that lifts and lowers a table upon which an individual lies in a supine position. Since all supports are concealed, the levitating individual cannot react with any prop and therefore no action may be simulated. The illusion requires motors, a stage with an opening formed it, and so on. If the structure is portable, it is not readily portable.

Another magician's apparatus is disclosed in U.S. Pat. No. 2,487,140 to Karson. A piece of cloth is held at its opposing top comers in concealing relation to a ball. A long wire extends from a finger of the magician that is held behind the cloth and the ball has a socket formed therein adapted to be engaged by a plug at the free end of the wire. This enables the magician to create the illusion that the ball is moving behind the cloth under its own power. A human individual could not be supported at the end of a finger-mounted wire so the Karson apparatus has no bearing on illusions or simulations that involve human individuals.

A ski position simulator is disclosed in U.S. Pat. No. 3,950,776 to Corrigan. The skis are mounted in cantilevered relation to a support stand and an individual then poses on the skis as if executing a jump. A photographer must frame the photograph by cropping the support stand out of the viewfinder of the camera. In doing so, the trailing ends of the skis are conspicuously chopped off at the edge of the photograph. Since the pair of skis cannot be in their entirety, the resulting photograph is easily identified as a simulation.

Nor does the Corrigan structure have the flexibility to allow a user to adopt a number of poses with the skis. The user simply leans forward, as if making a jump from a ramp, but the resulting photograph is low on the scale of authenticity. The apparatus approximates the look of a jumping skier but the resulting scene lacks realism. Nor is there an ability to capture a sequence of shots or any suggestion as to how a sequence of shots could be captured.

"Green screen" or "blue screen" technology includes the capturing of a person's image which is then digitally altered by computer means. Such technology can create very realistic action scenes, and such technology is in use in the tourist industry.

What is needed, then, is a new generation of photographic platforms that are not subject to the limitations of the well-known gag platforms of the past or to the limitations presented by levitation devices or techniques that rely on photograph cropping, blue screen technology, and the like. The new generation of photographic platforms should produce photographs and short films that appear to be authentic, with no hint of the use of support means, camera tricks, or digital alteration. The photographic subject, however, should be able to appear in such photographs while seated, standing, crouching, lying, jumping, or otherwise posed on a safe, non-moving platform so that the photography session is conducted in a safe, relaxed atmosphere. The resulting photograph should not be cropped, but should depict an entire piece of sport or generic equipment being used by an individual in a simulated action photograph. The equipment, like the individual apparently using it, should appear to be unsupported.

In the present disclosure, the term "unsupported" has two distinct meanings. In the first meaning, it refers to a photographed or filmed scene where an individual or individuals in said scene appear to be using equipment that has no apparent physical means of support. The actual support may appear in the scene, but it is disguised as a leash around an ankle, for example. In a second meaning, the actual support is not disguised but its use as a support means is not readily apparent.

For example, where an individual may appear to be riding a skateboard down an inclined rail, the rail or a safety surface connected to the rail provides the support for a stationary skateboard. However, in the resulting photograph, the rail seems to provide the challenge for the rider, not the support means for a safe, posed photograph. Thus it can be said that the individual is apparently unsupported.

As a further example, a photograph of a skier apparently hurtling over a jagged rock is said to be apparently unsupported although the skier is technically supported by the rock.

Thus, it could be said that the first type of support means is an "actual" support means that is disguised or concealed and the second type of support means is a "technical" support means because it is neither disguised nor concealed but appears to be a natural part of the environment for the activity being performed and a casual observer will not be aware of its support function.

In this way, it can be said that the individual is apparently unsupported when actually supported by a disguised or concealed support means or technically supported when supported by an undisguised, unconcealed object that appears to be a part of the natural environment of the scene.

In view of the prior art considered as a whole at the time the present invention was made, it was not obvious to those of ordinary skill in the pertinent art how the next generation of photographic platforms could be developed.

SUMMARY OF INVENTION

The long-standing but heretofore unfulfilled need for a method for creating a realistic illusion that an individual is engaged in an activity where he or she appears to be exercising great skill and athleticism while riding upon or otherwise using one or more pieces of sporting or non-sporting equipment in the apparent absence of support is now met by a new, useful, and nonobvious invention.

The novel method for creating an apparent action photograph includes the steps of providing a base that is generally flat and positioning the base atop a stable, non-moving support surface. An item of equipment is selected and a generally upstanding support means having a trailing end secured to the base and a leading end secured to the item of equipment is provided so that the item of equipment is supported in vertically spaced apart relation to the base. The support function of the support means is disguised so that even though the support means is in full view, its function is not readily guessed.

An individual is positioned in interactive relation to the item of equipment and a camera is specifically positioned so that the disguise of the support means is not compromised. The individual, the item of equipment, and the support means are then photographed. The item of equipment appears in the photograph as a complete item of equipment, there being no part thereof cropped by the photograph. Moreover, the item of equipment and the individual appear in the photograph to be unsupported.

The item of equipment may be disposed in a generally horizontal plane so that the individual may safely be positioned thereon without substantial risk of failing therefrom and so that the individual may jump with respect to the item of equipment without substantial risk of falling therefrom.

A safety surface may be secured to the item of equipment. The safety surface is adapted to support the individual in a posture that includes standing, sitting, crouching, reclining, hand-standing, and jumping. The item of equipment may be positioned into concealing relation to the safety surface.

The safety surface may be disposed in a generally horizontal plane so that the individual may safely be positioned on the safety surface without substantial risk of falling therefrom. A camera is specifically positioned so that the concealment of the safety surface is not compromised. In this way, the item of equipment need not be disposed in a generally horizontal plane.

The step of disguising the support function of the support means includes the step of configuring the support means so that it appears to be a part of the item of equipment. The item of equipment may be selected from a group of items consisting of a surfboard, a snowboard, a skateboard, a wakeboard and a kiteboard.

The step of disguising the support means also includes the step of configuring the support means to have the appearance of a leash adapted to extend from an ankle of the individual. More generally, the step of disguising the support function of the support means includes the step of configuring the support means to have the appearance of a part of an environment within which the item of equipment is associated.

For example, the step of disguising the support means may include the step of configuring the support means to have the appearance of a rail, and upstanding post, and the like.

The item of equipment may have a seat upon which the individual can sit. I may also have a handle means to which the individual can hold so that the individual can sit on the item of equipment even if the item of equipment is positioned at a steep angle relative to a horizontal plane.

In another embodiment of the invention, the novel method for creating an apparent action photograph includes the steps of providing a base that is generally flat, positioning the base atop a stable, non-moving support surface, preselecting an item of equipment, providing a generally horizontal safety surface adapted to support an individual so that the individual may safely be positioned on the safety surface without substantial risk of falling therefrom, providing a generally upstanding support means having a trailing end secured to the base and a leading end secured to the safety surface so that the safety surface is supported in vertically spaced apart relation to the base, disguising the support function of the support means, concealing the safety surface by attaching the item of equipment to the safety surface in concealing relation thereto, positioning an individual on the safety surface in interactive relation to the item of equipment to produce an illusion that the individual is using the item of equipment even though the item of equipment is unsupported by any apparent support means, specifically positioning a camera so that the concealment of the safety surface by said item of equipment is not compromised, and taking a photograph of the individual, the item of equipment, and the support means so that the item of equipment appears in the photograph as a complete item of equipment, there being no part thereof cropped by the photograph and so that the item of equipment and the individual appear in the photograph to be unsupported.

The item of equipment may be positioned at a sufficiently steep angle to prevent the individual from easily posing thereon. Accordingly, the individual is posed on the safety surface in a way that relates to the steeply angled orientation of the item of equipment. As in the earlier embodiments, the step of disguising the support function of the support means includes the step of configuring the support means so that it appears to be a part of the item of equipment or so that it has the appearance of a part of an environment within which the item of equipment is associated.

In still another embodiment, the method for creating an apparent action photograph includes the steps of providing a base that is generally flat, positioning the base atop a stable, non-moving support surface, mounting an upstanding support means to the base, disguising the function of the upstanding support means, preselecting an item of equipment, mounting a trailing end of a support member to the upstanding support means and a leading end of the support member to the item of equipment, disguising the support function of the support member, positioning an individual on the item of equipment in interactive relation to the item of equipment to produce an illusion that the individual is using the item of equipment even though the item of equipment is unsupported by any apparent support means, specifically positioning a camera so that the disguise of the upstanding support means and the support member is not compromised, and taking a photograph of the individual, the item of equipment, the upstanding support means and the support member so that the item of equipment appears in the photograph as a complete item of equipment, there being no part thereof cropped by the photograph and so that the item of equipment and the individual appear in said photograph to be spaced apart from yet unsupported by the base, the upstanding support means, and the support member.

The method of this embodiment further includes the step of disposing the item of equipment in a generally horizontal plane so that the individual may safely be positioned on the item of equipment without substantial risk of falling therefrom.

A flat safety surface adapted to support an individual may be secured to the item of equipment in coplanar relationship therewith. The flat safety surface may be concealed by securing the item of equipment thereto in concealing relationship therewith.

The item of equipment could be a two-wheeled vehicle and the support means could be concealed by a fender of such vehicle. The item of equipment could also be an automobile and the support means could be an apparent tailpipe of the automobile.

Yet another embodiment of the novel method for creating an apparent action photograph includes the steps of providing a base that is generally flat, positioning the base atop a stable, non-moving support surface, mounting an upstanding support means to the base, disguising the function of the upstanding support means, preselecting an item of equipment, providing a safety surface, mounting a trailing end of a support member to the upstanding support means and a leading end of the support member to the safety surface, mounting the item of equipment to the safety surface in concealing relation to the safety surface, disguising the support function of the support means or concealing the support means so that there is no need to disguise it, positioning an individual on the safety surface in interactive relation to the item of equipment to produce an illusion that the individual is using the item of equipment even though the item of equipment is unsupported by any apparent support means, specifically positioning a camera so that the disguise or concealment of the support means is not compromised, and taking a photograph of the individual, the item of equipment, and the upstanding support means so that the item of equipment appears in the photograph as a complete item of equipment, there being no part thereof cropped by the photograph and so that the item of equipment and the individual appear in the photograph to be unsupported.

In another embodiment, the novel method for creating an apparent action photograph includes the steps of providing a base that is generally flat, positioning the base atop a stable, non-moving support surface, mounting an upstanding support wall to the base, preselecting an item of equipment having at least two parts, providing a safety surface adapted to support an individual thereon, mounting the safety surface in cantilevered relation to the upstanding support wall, disguising the support function of the support wall, mounting a first part of the item of equipment to the safety surface in noncoplanar relationship therewith, concealing the safety surface by positioning a second part of the item of equipment in concealing relation thereto, specifically positioning a camera so that the disguise of the support means and the concealment of the flat safety surface is not compromised, and taking a photograph of the individual, the item of equipment, and the support means so that the item of equipment appears in the photograph as a complete item of equipment, there being no part thereof cropped by the photograph and so that the item of equipment and the individual appear in the photograph to be unsupported.

Another embodiment includes the steps of providing a base that is generally flat, positioning the base atop a stable, non-moving support surface, mounting an upstanding support wall to the base, preselecting an item of equipment, providing a safety surface adapted to support an individual thereon, mounting the safety surface in cantilevered relation to the upstanding support wall, and disguising the support function of the support wall. The item of equipment is held by the individual in non-coplanar relationship with the safety surface, thereby concealing the safety surface with item of equipment. A camera is specifically positioned so that the holding of the item of equipment and the concealment of the safety surface by the item of equipment is not compromised. A photograph of the individual, the first part, and item of equipment is taken so that the item of equipment appears in the photograph as a complete item of equipment, there being no part thereof cropped by the photograph and so that the item of equipment and the individual appear in the photograph to be unsupported.

A very specific embodiment includes the steps of providing a base that is generally flat, positioning the base atop a stable, non-moving support surface, mounting at least one upstanding post to the base, mounting at least one rail in surmounting relation to the at least one upstanding post, preselecting an item of equipment adapted to support an individual thereon, providing a safety surface, mounting the safety surface in cantilevered relation to the at least one rail so that the at least one rail conceals a first edge of the safety surface, mounting a first item of equipment to a free end of the safety surface so that the first item of equipment conceals a second edge of the safety surface, specifically positioning a camera in a first position so that the at least one rail conceals the first edge of the flat safety surface, specifically positioning the camera in a second position so that the first item of equipment conceals the second edge of the safety surface, taking a first photograph of the individual and the first item of equipment from the first position, and taking a second photograph of the individual and the first item of equipment from the second position so that the first item of equipment appears in the first and second photographs as a complete item of equipment, there being no part thereof cropped by the photograph and so that the first item of equipment and the individual appear in the photograph to be unsupported.

In another very specific embodiment, the novel method includes the steps of providing a base that is generally flat, positioning the base atop a stable, non-moving support surface, mounting an upstanding support wall to the base, disguising the function of the support wall, preselecting an item of equipment adapted to support an individual thereon, mounting a support means to the upstanding support wall in substantially parallel relation to the base, mounting the item of equipment to a free end of the support means, specifically positioning a camera so that the item of equipment conceals the support means, and taking a photograph of the individual, the upstanding support wall, and the item of equipment so that the item of equipment appears in the photograph as a complete item of equipment, there being no part thereof cropped by the photograph, and so that the item of equipment and the individual appear in the photograph to be unsupported. The support means may take the form of a post and the support means may take the form of a safety surface. The item of equipment may have a seat upon which the individual can sit and further may have a handle means to which the individual can hold so that the individual can sit on the item of equipment even if the item of equipment is positioned at a steep angle relative to a horizontal plane.

The novel method further includes the steps of providing a base that is generally flat, positioning the base atop a stable, non-moving support surface, preselecting an item of equipment adapted to support an individual thereon, mounting said item of equipment to the base at an angle thereto so that only a small part of the item of equipment is in abutting relation to the base, disguising the base, specifically positioning a camera so that the item of equipment conceals the support means, and taking a photograph of the individual and the item of equipment. In this way, the item of equipment appears in the photograph as a complete item of equipment, there being no part thereof cropped by the photograph, and the item of equipment and the individual appear in the photograph to be unsupported.

The steps of a further embodiment include providing a base that is generally flat, positioning said base atop a stable, non-moving support surface, providing a substantially horizontal safety surface, providing a support means having a trailing end secured to the base and a leading end secured to the safety surface so that the safety surface is supported in spaced apart relation to the base, positioning an individual on the safety surface such that the individual conceals the support means and the safety surface, specifically positioning a camera so that the concealment of the support means and safety surface is not compromised, and taking a photograph of the individual so that the individual appears in the photograph to be positioned above the base in the absence of any support means. The individual may be positioned in a supine posture atop the safety surface. Moreover, the arm of the individual may be positioned in concealing relation to the support means.

A novel photograph may also be produced by providing a base that is generally flat, positioning the base atop a stable, non-moving support surface, mounting an upstanding support wall to the base, preselecting an item of equipment, mounting a trailing end of a support means to the upstanding support wall and a leading end of the support means to the item of equipment, mounting a first safety surface in cantilevered relation to the upstanding support wall in a first preselected location, positioning an individual on the first safety surface so that the individual and the clothing of the individual conceal the first safety surface, posing the individual in interactive relation to the item of equipment, specifically positioning a camera so that the concealment of the support means is not compromised, and taking a photograph of the individual and the item of equipment so that the item of equipment appears in the photograph as a complete item of equipment, there being no part thereof cropped by the photograph and so that the individual appears in the photograph to be positioned above the base in spaced relation thereto in the absence of any support, thereby creating an illusion that the individual has leapt to the position above the base.

The novel photograph may be further enhanced by mounting a second safety surface in cantilevered relation to the upstanding support wall in a second preselected location, positioning the individual in seated relation to the first safety surface so that the individual and the clothing of the individual conceal the first safety surface, positioning a first foot of the individual atop the second safety surface, positioning a second foot of the individual in concealing relation to the second safety surface, posing the individual in interactive relation to the item of equipment, specifically positioning a camera so that the concealment of the second safety surface is not compromised, and taking a photograph of the individual and the item of equipment so that the item of equipment appears in the photograph as a complete item of equipment, there being no part thereof cropped by the photograph and so that the individual appears in the photograph to be positioned above the base in spaced relation thereto in the absence of any support, thereby creating an illusion that the individual has leapt to the position above the base.

In another variation of the novel method, the novel steps include providing a base that is generally flat, positioning the base atop a stable, non-moving support surface, mounting an upstanding support means to the base, mounting a safety surface in cantilevered relation to the upstanding support means in a first preselected location, preselecting an item of equipment, concealing the safety surface by mounting the preselected item of equipment to an edge of the safety surface, positioning an individual on the first safety surface in interactive relation to the item of equipment, specifically positioning a camera so that the concealment of the safety surface is not compromised, and taking a photograph of the individual and the item of equipment so that the item of equipment appears in the photograph as a complete item of equipment, there being no part thereof cropped by the photograph and so that the individual appears in the photograph to be positioned atop the item of equipment in spaced relation above the base. The item of equipment may be a tightrope.

In a final example of the novel method, the steps include providing a base that is generally flat, positioning the base atop a stable, nonmoving support surface, mounting an upstanding support means to the base, disguising the function of the upstanding support means, preselecting an item of equipment, providing a safety surface, mounting a trailing end of a support member to the upstanding support means and a leading end of the support member to the safety surface, mounting the item of equipment to the safety surface in concealing relation to the safety surface, further mounting the item of equipment to the safety surface in concealing relation to the support means, positioning an individual on the safety surface in interactive relation to the item of equipment to produce an illusion that the individual is using the item of equipment even though the item of equipment is unsupported by any apparent support means, specifically positioning a camera so that the disguise of the support means is not compromised, and taking a photograph of the individual, the item of equipment, and the upstanding support wall so that the item of equipment appears in the photograph as a complete item of equipment, there being no part thereof cropped by the photograph and so that the item of equipment and the individual appear in the photograph to be unsupported.

An important object of this invention is to provide a safe photographic platform upon which a photographic subject may assume any pose, including but not limited to sitting, crouching, standing, lying upon, jumping, performing a hand stand, and the like, to create an illusion that the subject is engaged in an activity that may or may not be related to a sport.

Another very important object is to provide a method for simulating action where an individual and an item of equipment appear to be engaging in an activity in the absence of any apparent support means.

An object closely related to the foregoing object is to provide a method where the equipment used therein is fully visible in the photograph.

Another object is to provide a method for simulating action where an individual appears to be suspended in air while interacting with sporting or non-sporting equipment where both the individual and the equipment lack visible or apparent means of support.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which:

FIG. 3A is a perspective view of a snowboard platform where the snowboard itself serves as a safety surface;

FIG. 3B is a front elevational view of the snowboard platform of FIG. 3A from the perspective of a camera specifically positioned to create an illusion;

FIG. 6C is a perspective view of a skiing platform having a safety surface disguised as an item of sporting equipment;

FIG. 6D is a front elevational view of the skiing platform of FIG. 6C from the perspective of a camera specifically positioned to create an illusion;

FIG. 9A is a front elevational view of a bicycle platform;

FIG. 9B is a rear elevational view of the bicycle platform of FIG. 9A;

FIG. 10A is a perspective view of a motorcycle platform depicting four different ways to mount a motorcycle to either a disguised support means or to the base of the platform;

FIG. 10B is a side elevational view of one of the motorcycles depicted in FIG. 10A;

FIG. 10C is a side elevational view of another one of the motorcycle depicted in FIG. 10A;

FIG. 11A is a perspective view of an automobile platform where the base of the platform may serve as a safety surface;

FIG. 11B is a front elevational view of the automobile platform of

FIG. 11A from the perspective of a camera specifically positioned to create an illusion;

FIG. 14A is a perspective view of a tightrope platform having a safety surface upon which a subject may stand in a walking posture to create an illusion; and FIG. 14B is a front elevational view of the tightrope platform of FIG. 14A from the perspective of a camera specifically positioned to create an illusion.

DETAILED DESCRIPTION

Figure 1A:
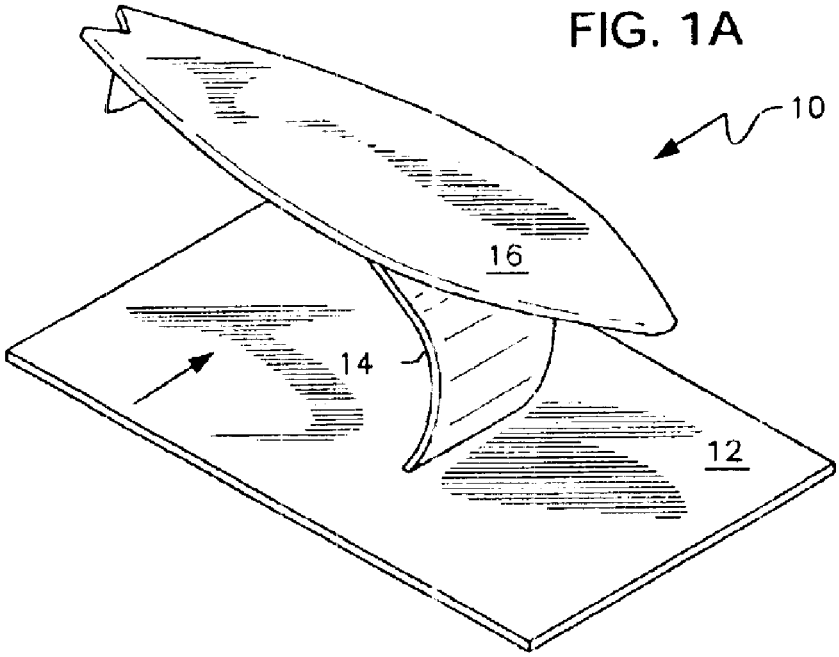
FIG. 1A is a perspective view of a surfboard platform where the surfboard itself serves as a safety surface.
Figure 1B:
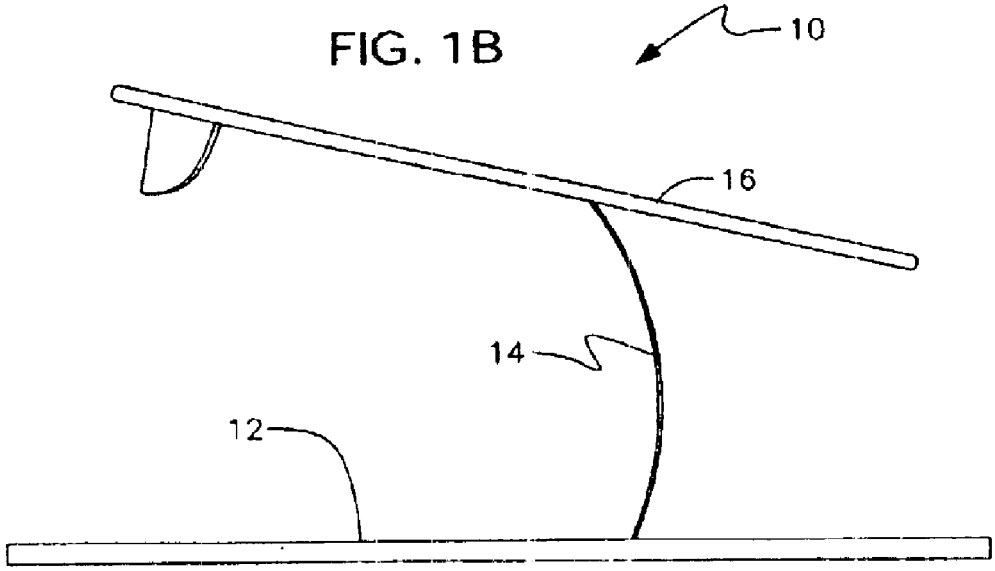
FIG. 1B is a front elevational view of the surfboard platform of FIG. 1A from the perspective of a camera specifically positioned to create an illusion.

Referring now to FIGS. 1A and 1B, it will there be seen that the reference numeral 10 denotes a first embodiment of the present invention as a whole. Photographic platform is a mobile structure that can be folded and transported onto cruise ships, into shopping malls, theme parks, and the like. It includes a base 12 that is adapted to overlie a support structure such as a floor of a building or the ground. When placed into position atop a non-moving support surface, it provides a stable, non-moving support surface that may be walked upon.

Photographic platform 10 further includes rigid support means 14 that is mounted to base 12, and a surfboard 16 that surmounts said rigid support means 14. Surfboard 16, in this first embodiment of the invention, is disposed in a substantially horizontal plane so that said surfboard serves as its own safety surface. A photographic subject may strike any pose, including sitting, crouching, standing, lying, jumping, standing on his or her head, and the like, while positioned atop surfboard 16. Although a jumping person may be considered as momentarily not being positioned atop a surface, whenever used herein the term "positioned upon" or similar terms shall include all of the above-mentioned postures as well as any posture struck while a photographic subject is in the air due to having performed a jump.

Support means 14 may be concealed by water that is splashed in sufficient quantity onto platform 10 at the moment a photograph is taken.

In still another concealment technique, support means 14 appears to be a leash that extends from the surfer's ankle, not shown, to surfboard 16. For this reason, support 14 is arcuate as depicted, to make it appear to be a flexible leash dangling from the surfer's ankle. An additional support means like support means 14 could be added and made to look like a second end of the surfboard leash. Thus, it can be said that the support means is disguised as a leash.

The camera perspective denoted 18 in FIG. 1B produces the front elevational view of FIG. 1A. In all embodiments, camera positioning can be critical. The exact camera positioning is to be selected by the photographer. The framing of an image by the camera viewfinder is not depicted in any of the Figures of this disclosure.

It should be understood that surfboard 16 may be replaced by many other items of equipment, and that said equipment may be related to conventional sports, extreme sports, or to strenuous or even fantasy activities involving non-sports equipment or no equipment at all. For example, a windsurfing board, a kayak, a canoe, and any other number of conventional or extreme sporting equipment items could be mounted atop support means 14, as could any non-sporting equipment.

Figure 2A:
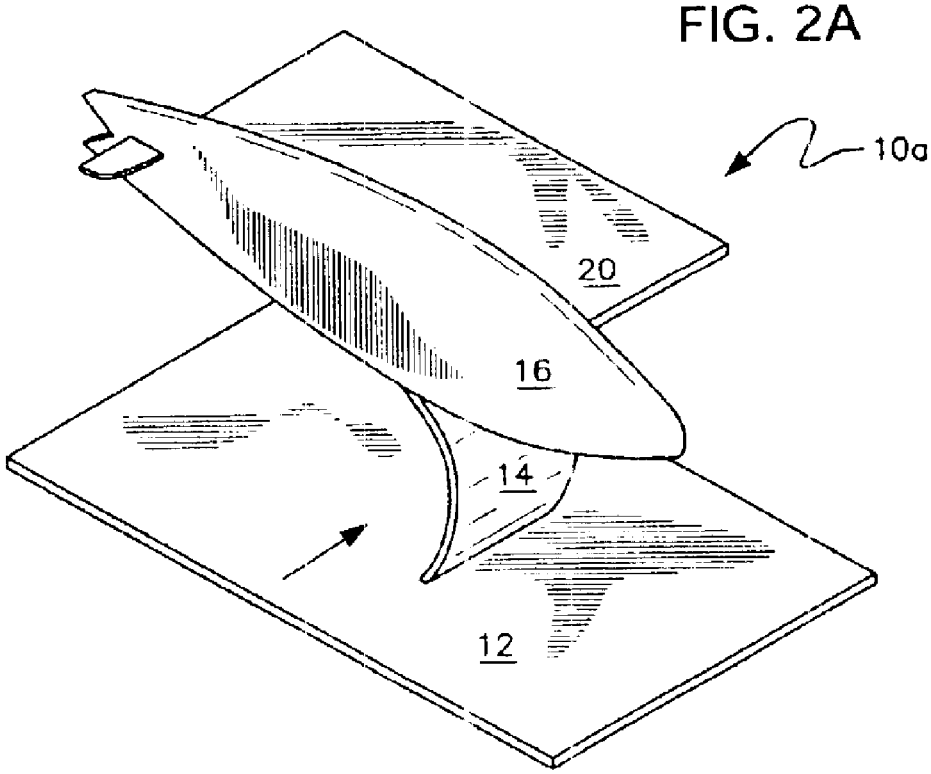
FIG. 2A is a perspective view of a surfboard platform having a safety surface apart from the surfboard itself.
Figure 2B:
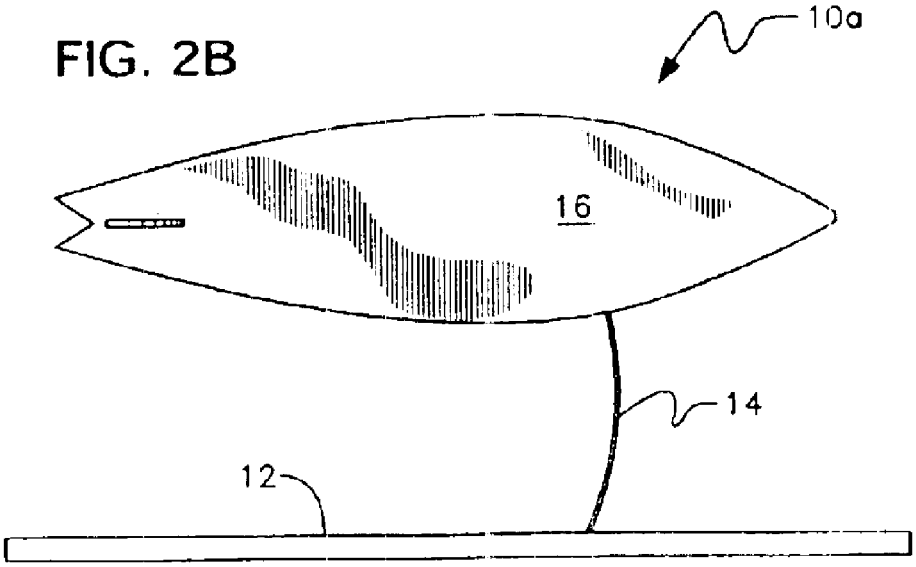
FIG. 2B is a front elevational view of the surfboard platform of FIG. 2A from the perspective of a camera specifically positioned to create an illusion.

FIGS. 2A and 2B depict a surfboard platform as well, but embodiment 10*a* includes a safety surface 20 upon which an individual may sit, stand or lie down upon, depending upon the photograph desired. Note that safety surface 20 is concealed by surfboard 16 in the frontal view of FIG. 2B.

Snowboards, for the same reason as surfboards, are typically leashed to the ankle of the user. In the snowboard photographic platform of FIGS. 3A and 3B, upstanding support means 22 is mounted to a preselected end of base 12 and support means 14*a* extends therefrom in cantilevered relation thereto. A snowboard 24 is secured to the distal end of said support means 14*a*. Significantly, said support means 14*a* is disguised as a snowboard leash so that its appearance in the photograph is natural and its function as a support means is not readily apparent.

In this particular embodiment, upstanding support means 22 is disguised as a rock of the type that might be seen in a snowboarding event. Upstanding support means 22 may also be provided in the form of an ordinary flat wall, or other upstanding, utilitarian upstanding support means that is concealed from view by a naturally-occurring element such as a tree, rock or the like. In other words, any upstanding support means could be positioned behind a rocky outcrop of the type that might be expected to be seen in a snowy mountain scene, or the rocky outcrop could serve as the upstanding support means as in the illustrated embodiment. In the latter situation, the rocky outcrop appears to be a rocky outcrop when in fact it is a support means. This is another example of what is meant when it is said that the function of an element that is not hidden from view is disguised. It appears to be something other than what it is, and its presence enhances the illusion even when it is in full view.

The same observation applies to support means 14*a* which is disguised as a leash. Even when in full view, its support function is not guessed because it appears to be a leash trailing from the ankle of a snowboarder.

Nor are support walls or other support means the only items that can be concealed or placed in full view in a disguised condition. In all embodiments, the safety surfaces may also be concealed or disguised. In some cases, a concealment means may also function as a disguise, as indicated in connection with a ski scene disclosed below.

Figure 4A:
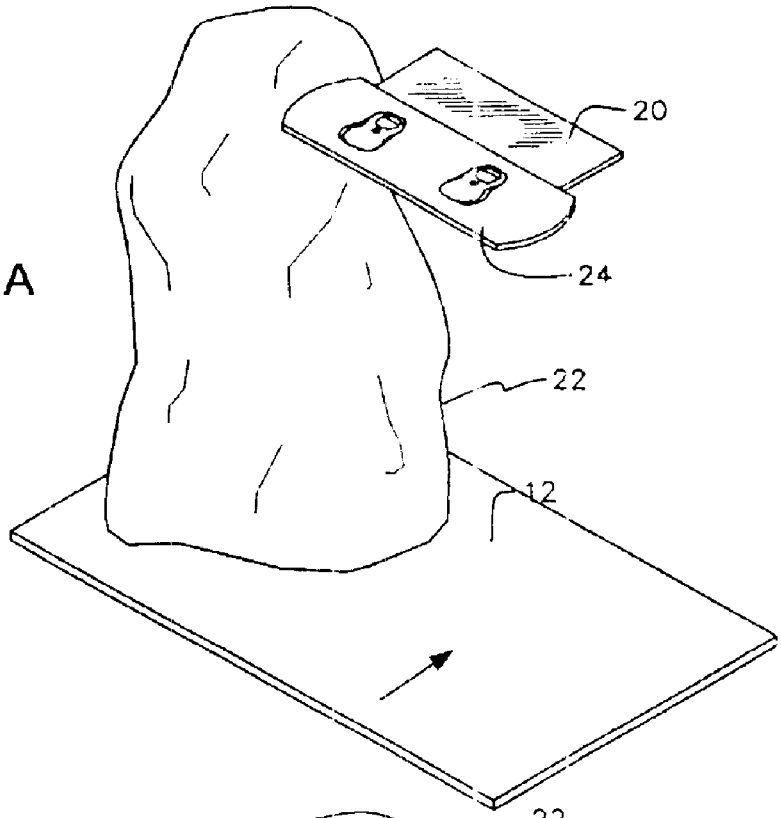
FIG. 4A is a perspective view of a snowboard platform having an optional safety surface where the snowboard itself could serve as a safety surface in the absence of said optional safety surface.
Figure 4B:
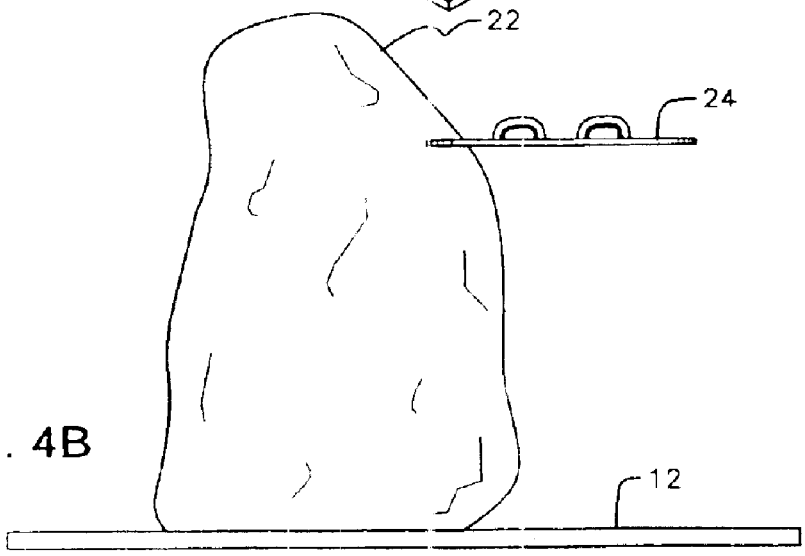
FIG. 4B is a front elevational view of the snowboard platform of FIG. 4A from the perspective of a camera specifically positioned to create an illusion.

Note that snowboard 24 may be positioned at an angle as depicted in FIGS. 3A and 3B or it may be horizontal as depicted in FIGS. 4A and 4B. As long as it is horizontal (parallel to base 12) or nearly horizontal, snowboard 24 may serve as its own safety surface.

In the embodiment of FIGS. 4A and 4B, a safety surface 20 is secured to a rear edge of snowboard 24 in coplanar relationship therewith. Safety surface 20 is therefore concealed from view by snowboard 24 when viewed from the camera perspective that produces the view of FIG. 4B. Safety surface 20 is optional in this particular embodiment because snowboard 24 is not angled and could serve as its own safety surface. However, the addition of safety surface 20 enables a user to strike a more dramatic pose than might be feasible without said safety surface. For example, it would not be safe to perform a handstand on snowboard 24 due to its narrow structure and its elevation from base 12. However, the addition of safety surface 20 widens the area upon which a handstand, or other dramatic pose, could be performed.

Note further the cantilever mounting of snowboard 24 and safety surface 20 relative to upstanding support means 22. This eliminates support means 14*a* of the previous embodiment. Upstanding support wall 22 may also be made of arcuate configuration, much like support means 14 in the first two embodiments, so that it appears to be a snowboard leash. It may also be disguised as a sand dune, a rock, or other naturally occurring element.

Figure 5A:
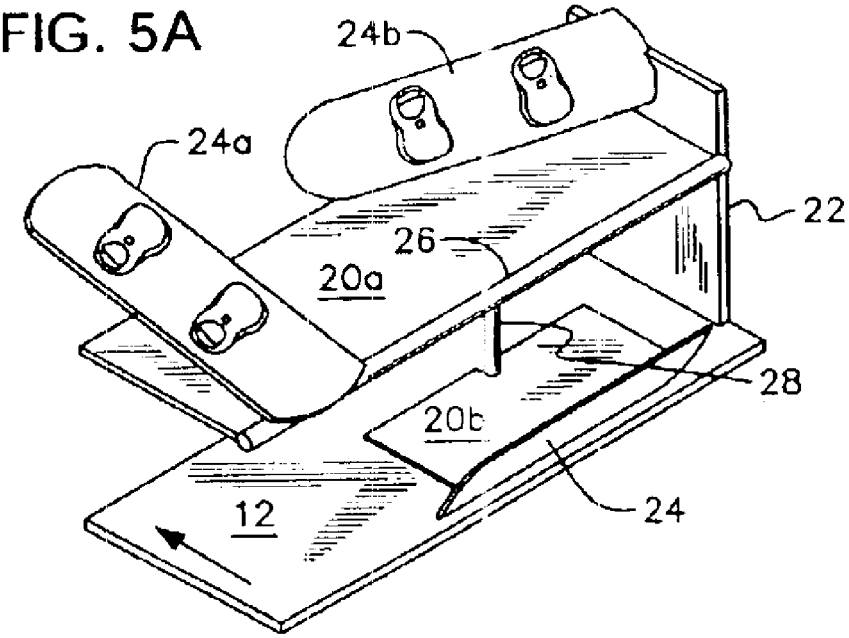
FIG. 5A is a perspective view of a plurality of snowboard platforms where two of the snowboards could serve as safety surfaces and where two separate safety surfaces are provided.
Figure 5B:
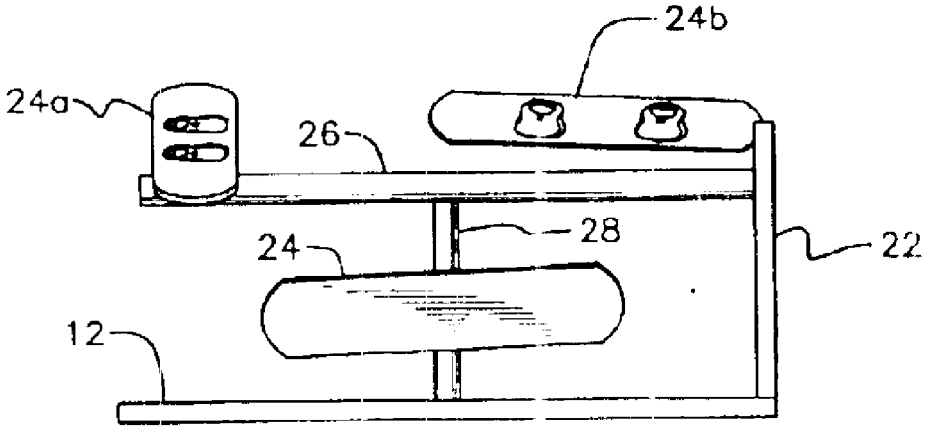
FIG. 5B is front elevational view of the snowboard platform of FIG. 5A from the perspective of a camera specifically positioned to create an illusion.

FIGS. 5A and 5B illustrate another snowboard platform, but as aforesaid other items of sporting equipment may be substituted for such snowboards. It should be understood that although three (3) snowboards are depicted in this example, generally one of them would most likely appear in a photograph. Where two or more people want a group photo or short film, two or more of the snowboards are used at the same time. There are two (2) safety surfaces 20 in this particular embodiment. One of them, denoted 20*a*, is mounted in cantilevered relation to and concealed by rail 26 whereas the other one, denoted 20*b*, is mounted to upstanding post 28 and is concealed by a snowboard.

Rails 26 and posts 28 are common, naturally present elements in snowboard parks so their appearance in a photograph adds an element of authenticity to the photograph. Since the viewer of the photograph expects to see such elements, it does not occur to the viewer that such elements could be concealing safety surface 20*a* or providing a mount to which safety surface 20*b* is secured.

Upstanding support means 22 is here depicted as a wall which can also be interpreted as a part of the natural scene, but in a preferred embodiment it would look more like a post, it would be disguised as a bush or other natural element, or it would be concealed behind a bush or other natural element.

A photographic subject can stand safely with one foot on safety surface 20*b* and another foot on a snowboard 24, making it appear that a jump is being executed with only one foot on the board. Various crouching poses, or even a handstand, could be performed on safety surface 20*b*.

Note that snowboard 24*a* is secured in cantilevered relation to rail 26 and snowboard 24*b* is secured in cantilevered relation to upstanding support wall 22. Depending upon the angle of snowboard orientation for the shot, it should be clear that said snowboards 24*a*, 24*b* could serve as their own safety surfaces. Significantly, due to the presence of safety surface 20, said snowboards may be angled sharply from the horizontal in virtually any angular orientation.

Figures 6A, 6B:
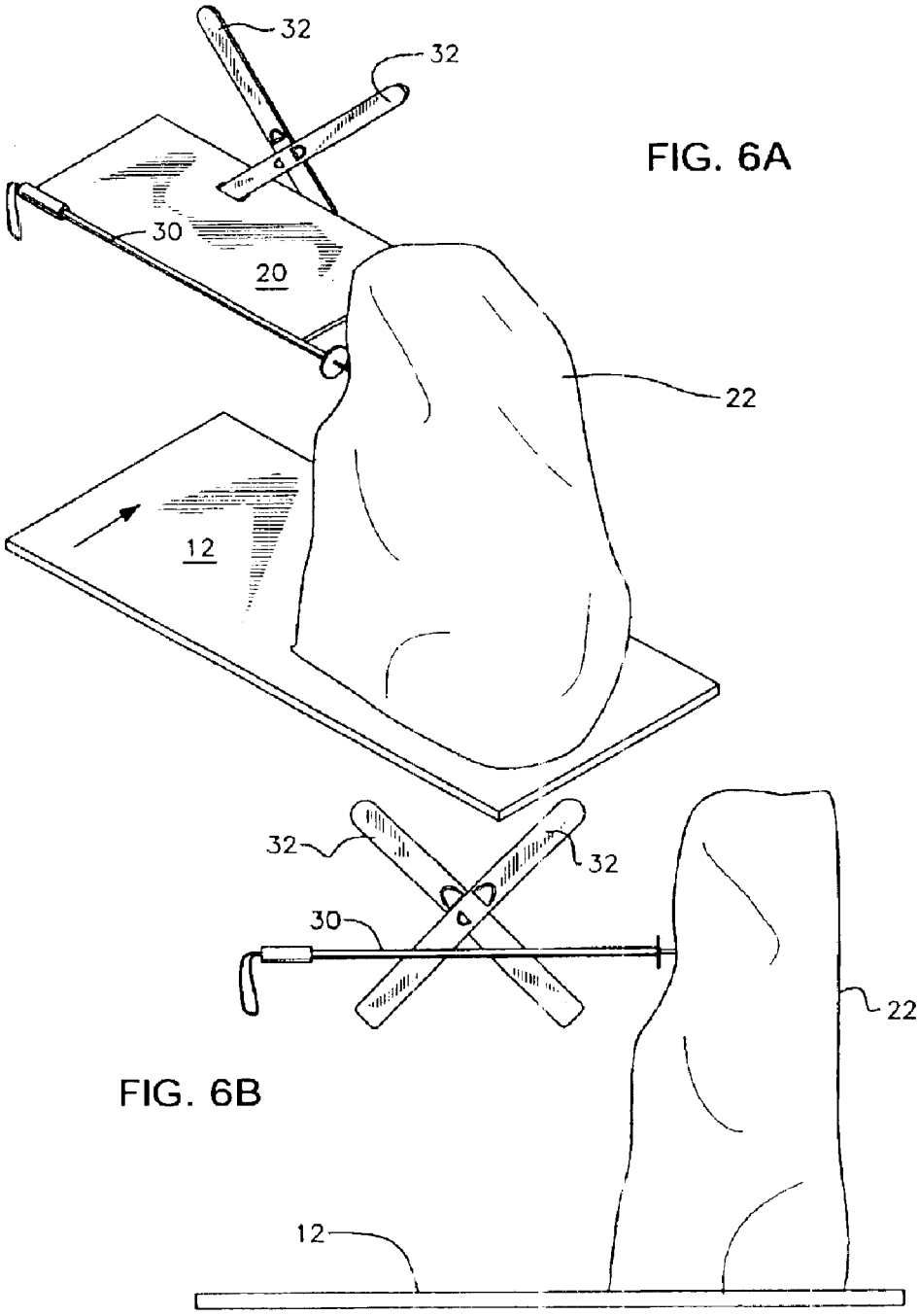
FIG. 6A is a perspective view of a skiing platform having a safety surface concealed by an item of sporting equipment.
FIG. 6B is a front elevational view of the skiing platform of FIG. 6A from the perspective of a camera specifically positioned to create an illusion.

Nor is the invention limited to photographic platforms where naturally present elements of the environment are used to mask the safety surface or support means. In the embodiment of FIGS. 6A and 6B, a part of the sporting equipment itself is used to conceal safety surface 20. In this particular example, a ski pole 30 is secured to an edge of safety surface 20 so that only said ski pole is visible in the frontal view of the photographic platform as disclosed in FIG. 6B. The ski pole thus conceals the safety surface but it also functions as an active part of the scene because it is a part of the equipment that is apparently in use. Thus, it performs a concealment function in a way different than a rock or other naturally occurring element in a scene.

Moreover, because the ski pole is in full view, it may be said to be in disguise because it appears to be an item of sporting equipment when in fact it is a concealment means that may be permanently attached to a safety surface and as such in not in use as a ski pole.

An individual lies, sits, or otherwise is positioned on safety surface 20 with his or her feet positioned in the bindings of skis 32 and with a hand gripping ski pole 30.

Note that one or both of skis 32 may penetrate safety surface 20; this enhances the realism of the photo taken from the camera perspective that produces the scene of FIG. 6B.

The safety surface itself may also be exposed to full view yet be disguised so that its real function is not surmised. In FIGS. 6C and 6D, for example, there is no ski pole to conceal the edge of safety surface 20. Instead, a ski pole handle 21*a* is added to the left edge of safety surface 20 and ski pole basket 21*b* is added to the safety surface near its trailing end. These two items trick the observer into assuming that the edge of the safety surface is a ski pole.

In the same way, many other illusions can be created. For example, an element that looks like the leading end of a toboggan can be added to the left end of the safety surface in FIGS. 6C and 6D and an element that looks like the trailing end of a toboggan may be added to the right end thereof and said element would be secured to upstanding support means 22 having the form of a rock in this example. The exposed edge of the safety surface will then have the appearance of the body of a toboggan. Skis 32 would be removed to complete a picture of a toboggan apparently zooming past a rock.

The same technique may also be applied to disguise items of equipment as well, not just safety surfaces.

The disguise function may be performed by any item of sporting or non-sporting equipment, not just a ski pole. A snowboard, a ski, and the like could be substituted for the ski pole.

In the example of FIGS. 6A, 6B, 6C, and 6D, a pair of skis 32 is secured to safety surface 20; the skis may be secured to a trailing edge of safety surface 20 or they may penetrate said safety surface. Moreover, they may be mounted to the top surface of safety surface 20 or to the bottom surface thereof. Any it em of equipment or any appendage such as an arm or a leg of an individual may also be disposed in penetrating relation to a safety surface.

Safety surface 20 is mounted to upstanding support means 22 in cantilevered relation thereto. Any item of sporting or non-sporting equipment may be mounted thereto, not just skis 32. Note that safety surface 20 need not be perfectly horizontal. In most simulated action photos, a slight incline from the horizontal will enhance the apparent authenticity of the shot. Note also that upstanding support means 22 may be replaced by any naturally occurring element so that its support function is not surmised.

Note further that an individual standing on safety surface 20 could also sit, crouch, jump, or assume some other posture on safety surface 20, with his or her back to the camera, and hold an item of sports equipment so that such item would not need to be mounted to said safety surface.

Figure 6E:
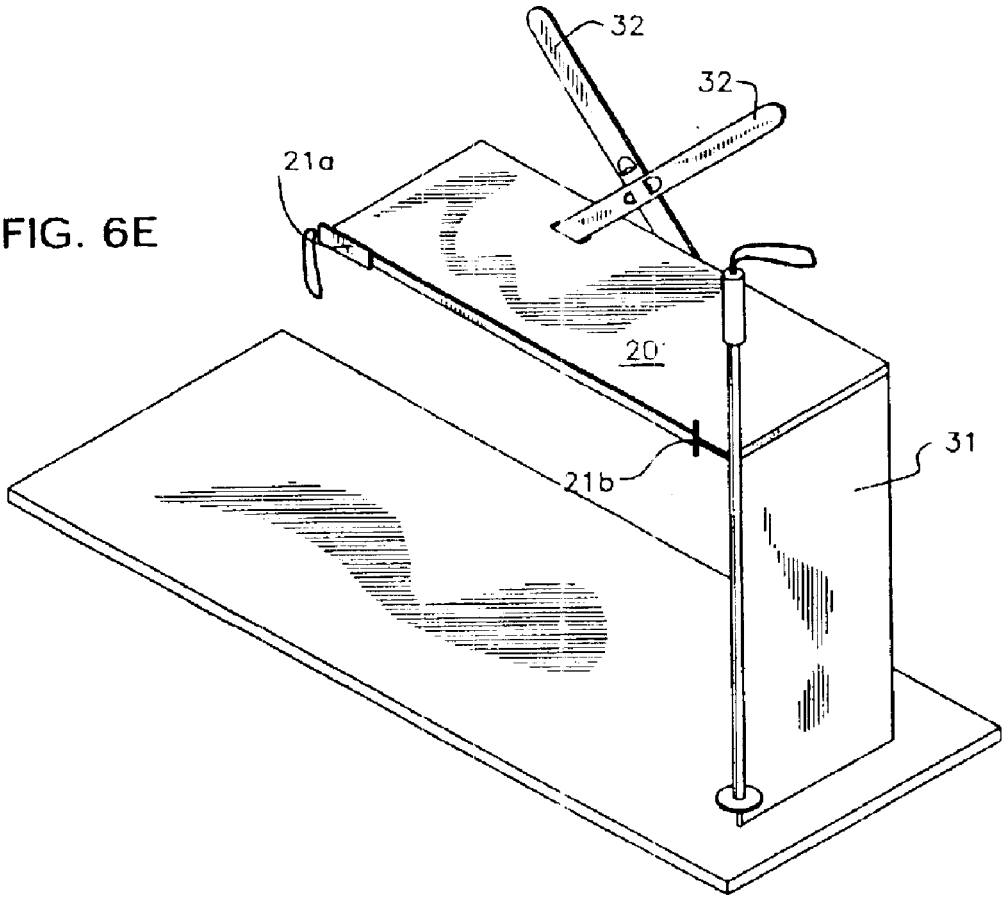
FIG. 6E is a perspective view of a skiing platform having an upstanding support surface disguised as an item of sporting equipment.
Figure 6F:
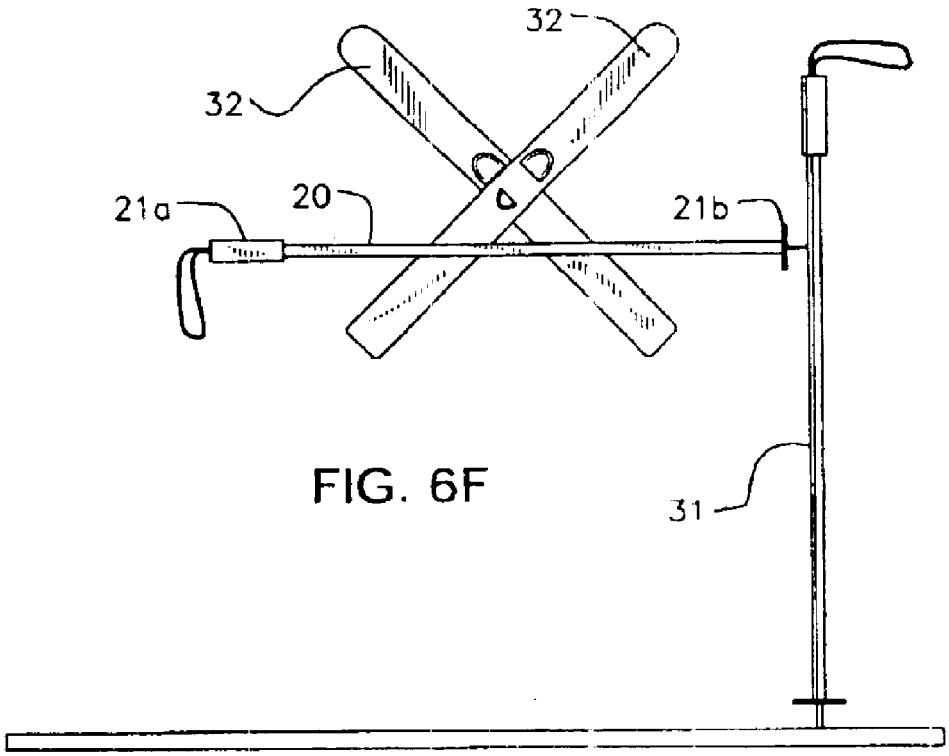
FIG. 6F is a front elevational view of the skiing platform of FIG. 6E from the perspective of a camera specifically positioned to create an illusion.

FIGS. 6E and 6F depict an embodiment where upstanding support means 22 is replaced by upstanding support means 31 having the appearance of a ski pole. An individual posing relative to safety surface 20 could grip ski pole 31 to further enhance the scene and to further disguise the support function of said upstanding support means 31. Item 31 is preferably formed of steel and is not a ski pole.

Figure 7A:
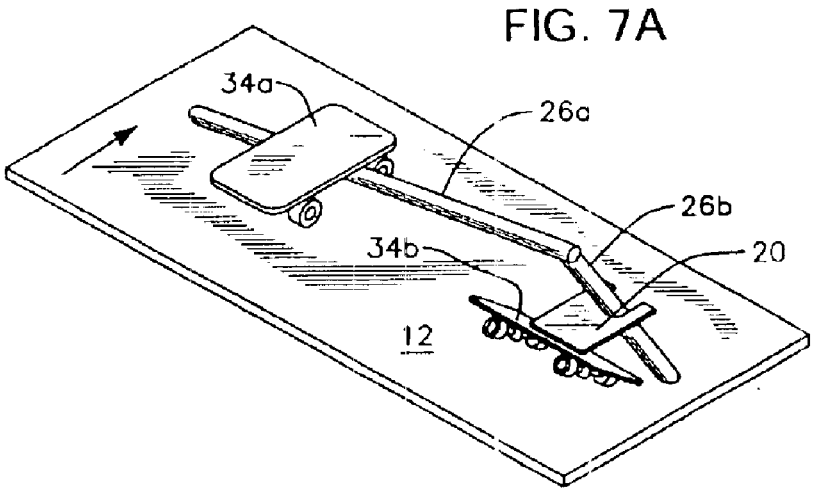
FIG. 7A is a perspective view of a skate platform where one skateboard serves as its own safety surface and where a second skateboard has a concealed safety surface.
Figure 7B:
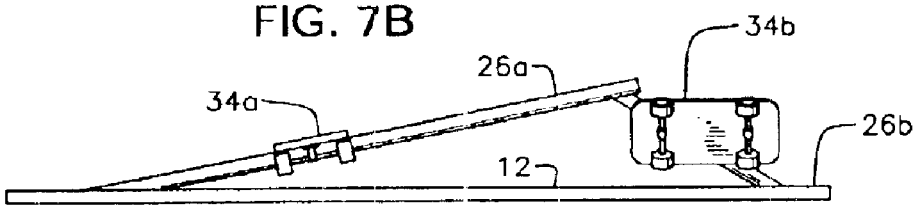
FIG. 7B is a front elevational view of the skate platform of FIG. 7A from the perspective of a camera specifically positioned to create an illusion.

In a seventh example of the inventive method, depicted in FIGS. 7A and 7B, rails 26*a*, 26*b* are mounted to base 12 to provide the appearance of a skateboard park when the novel photographic platform is viewed from the camera perspective of FIG. 7B. A first skateboard 34*a* is mounted directly to rail 26*a* in substantially parallel relation to base 12 and therefore serves as its own safety surface. Rail 26*a* need not be masked because it is a common element of a skateboard park. A second skateboard 34*b* is secured in angular relation to safety surface 20 which is secured to rail 26*b*. Second skateboard 34*b* conceals said safety surface, thereby providing another example of how an item of sports equipment may serve as a masking means for a safety surface. Note that the angular disposition of skateboard 34*b* is too steep for an individual to stand upon. Accordingly, the individual assumes a position atop safety surface 20 in such a way as to be consistent with the angular orientation of skateboard 34*b*. As in all other embodiments, the position assumed is unrestricted and includes postures assumed while jumping above the safety surface.

Figure 8A:
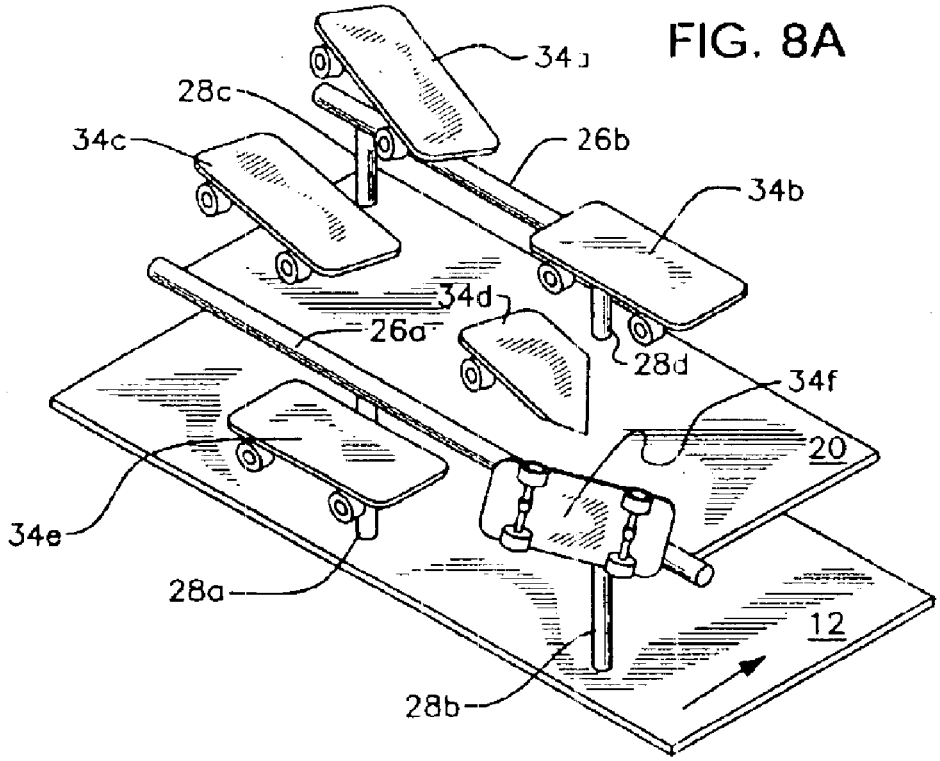
FIG. 8A is a perspective view of a skate board platform having a safety surface associated with some of the skate boards and having some skate boards serving as their own safety surface.
Figure 8B:
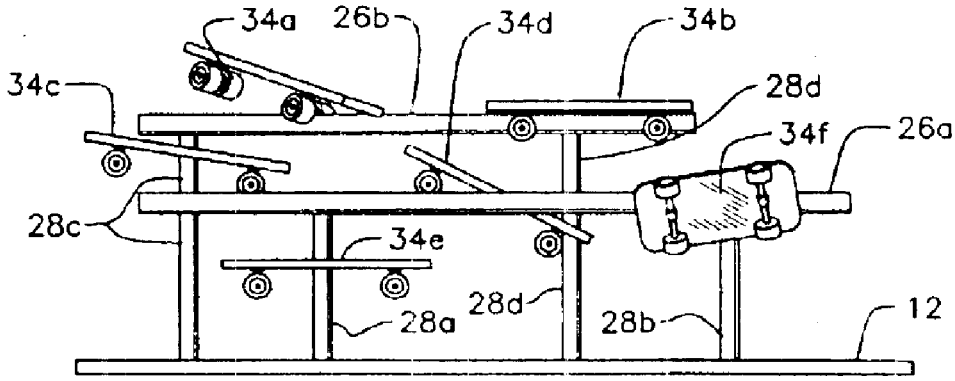
FIG. 8B is a front elevational view of the skate platform of FIG. 8A from the perspective of a camera specifically positioned to create an illusion.

FIGS. 8A and 8B depict another photographic platform where the simulated environment is that of a skateboard park. A first apparent rail is denoted 26*a* and is supported by upstanding posts 28*a*, 28*b* and a second apparent rail 26*b* is elevated with respect to rail 26*a* and is supported by upstanding posts 28*c*, 28*d*. Safety surface 20 extends in cantilevered relation to rail 26*a* and is concealed thereby. Upstanding posts 28*c*, 28*d* also support safety surface 20 and thus provide more support thereto than would be provide by a cantilever mounting alone.

It will be observed in FIGS. 8A and 8B that four of the skateboards 34 are mounted directly to a rail or a post and that two of the skateboards are supported by concealed safety surface 20. One of the latter penetrates safety surface to further conceal the presence of said safety surface. A person posing on the safety surface could similarly position an arm, a leg, or a head through an opening formed in the safety surface, thereby further strengthening the illusion and drawing attention away from the presence of a safety surface.

The two skateboards 34*a*, 34*b* secured to elevated rail 26*b* are disposed close to horizontal and thus may be stood directly upon, i.e., said skateboards serve as their own safety surfaces. The two skateboards 34*c*, 34*d* mounted to safety surface 20 are angled too steeply for both feet of an individual to stand comfortable atop, so the individual may pose with one foot on the skateboard and one foot on safety surface 20. Skateboard 34*e* mounted to upstanding post 28*a* may be stood upon or an individual could pose atop safety surface 20 and place his or her foot or feet on said skateboard, or the individual could stand next to base 12 and place one foot on said skateboard. For a pose associated with skateboard 34f mounted to rail 26*a*, the individual would probably crouch or otherwise pose on safety surface 20 with one foot on said skateboard and one foot on said safety surface.

It should be understood, however, that the particular arrangement of skateboards depicted in FIGS. 8A and 8B is entirely exemplary and the invention is not restricted to this particular arrangement of elements. As in all other embodiments of the invention, the depicted structure is for illustrative purposes. Thus, the angular orientation of each skateboard may be changed and the position of each skateboard may be changed. Items of sporting equipment other than skateboards, such as bicycles, could be used as well. Again, it should also be remembered that in most cases only one item of sports equipment would appear in an actual photograph, unless two or more people elect to pose as a group. To maintain the apparent authenticity of the photo, all unoccupied items would be removed from the photographic platform prior to the shot.

For extra effect when a series of still photos or a short film is made, the skateboards or other items of equipment may be moved along the extent of a rail or other disguised or concealed support surface. However, the longer such a scene lasts, the more likely it will be that the viewer will realize that a disguised or concealed support means is in use.

A photographic platform for holding sport bikes is depicted in FIGS. 9A and 9B. Rails 26 and posts 28 are not concealed in this embodiment as they form a natural part of a park built for extreme bike riding. In this particular example, the frame of bike 36*a* conceals safety surface 20 but it could also be concealed by another part of the bike as well, such as the handlebars, for example. The front tire of bike 36*b* is secured to rail 26 and the grind pegs 38 of bike 36*c* are secured to an inclined section of said rail 26.

FIG. 9A provides a front elevational view of this photographic platform where safety surface 20 is hidden by said frame of bicycle 36*a*, and FIG. 9B provides a rear elevational view thereof where safety surface 20 is concealed by rail 26.

In the tenth example, depicted in FIGS. 10A, 10B, and 10C, support means 22 is disguised as a large rock and is positioned in the middle of base 12. As in all other embodiments, support means 22 could be an undisguised utilitarian wall or other support means that is concealed behind what appears to be a naturally present element. As perhaps best depicted in FIG. 10B, a front fender of motorcycle 40*a* is connected directly to disguised support means 22 so that said motorcycle is positioned, at a preselected angle, in spaced relation above base 12. A rear fender could also be so connected. Either way, a casual onlooker will not appreciate the fact that the front or rear fender is embedded in support means 22. Significantly, a motorcycle, like a bicycle of the previous embodiment, provides its own safety surface in the form of the motorcycle seat. Thus, even though motorcycle 40*a* (FIG. 10B) is positioned in airborne relation to base 12, it is safe for an individual to be seated on the motorcycle seat of said vehicle 40*a*. Similarly, motorcycle 40*b* (FIG. 10C) is secured to base 12 at a dramatic, action-simulating angle, but it is safe for an individual to sit in the seat thereof. Motorcycles 40*c* and 40*d* are secured to disguised support means 22 by a horizontally-extending post 42 and by a safety surface 20, respectively. Although safety surface 20 need not be relied upon as a platform upon which to stand or sit, in view of the presence of the seat of motorcycle 40*d*, said safety surface could be used as a standing or jumping surface so that that the individual would appear to be standing on the seat of the motorcycle or suspended in the air above said seat at the moment recorded by the photographer.

Instead of motorcycles, this photographic platform would also work well with other vehicles such as automobiles, boats, aircraft, bicycles, and the like.

The embodiment of FIGS. 11A and 11B includes means for displaying an automobile 44 in an action pose, such as spaced above base 12 and in an inclined position. A support member 46 disguised to look like a tailpipe is advantageously used to hold the vehicle in the desired position. Support member 46 extends from upstanding support wall 22 which could be disguised as a flagpole, a tree, or the like. A motorcycle, aircraft, boat, or other vehicle may be mounted in an action pose to support wall 22 by a similar technique. The individual in the photograph may sit in the driver's seat of the vehicle to create the illusion that the individual is a skilled stunt driver, or the individual may climb onto or into the vehicle at any other location to create an illusion that the individual is interacting with a stunt driver.

A car could be equipped with a seat that can be inverted so that an individual could get into the seat in the ordinary way while car 44 is in an inverted position. The individual would fasten a seat belt and then the seat would be inverted to match the position of the car. In the alternative, car 44 could be in a non-inverted posture with an ordinary seat when the individual is seated therein and the car could be inverted after the seat belt has been fastened.

Figure 12A:
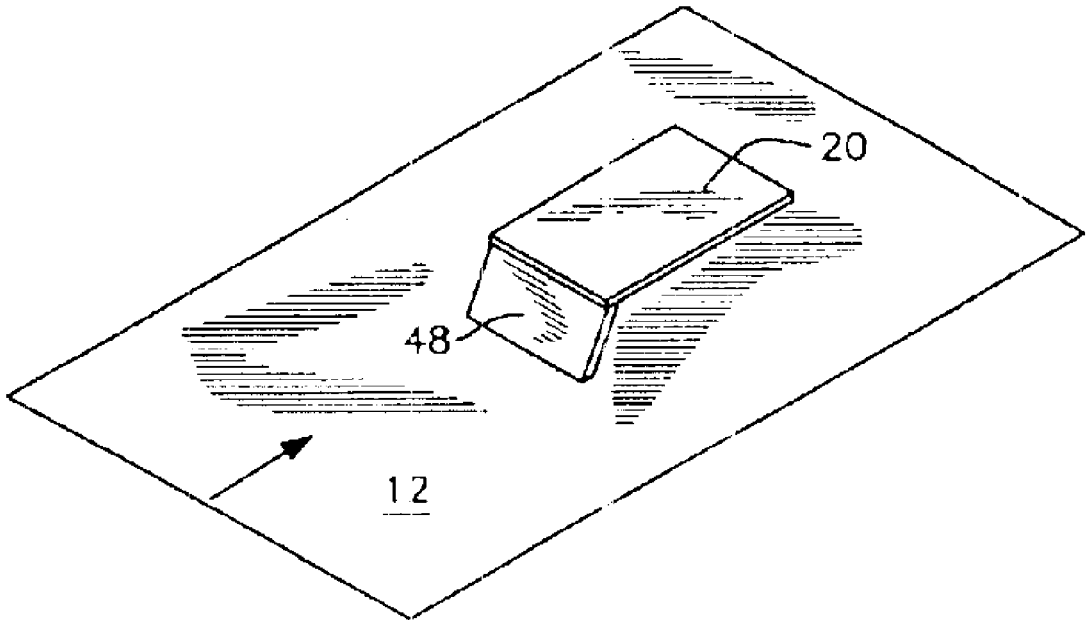
FIG. 12A is a perspective view of a baseball platform having a safety surface upon which a subject may lie to create an illusion.
Figure 12B:
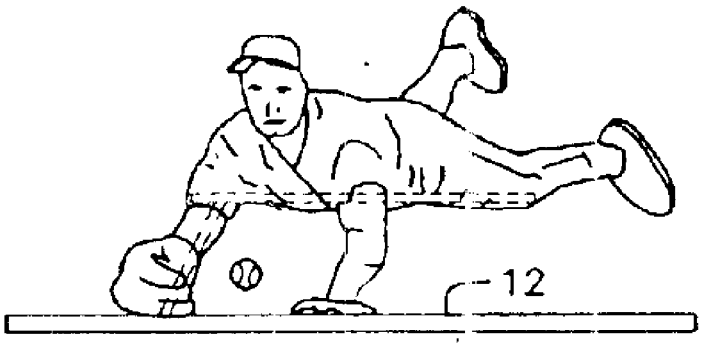
FIG. 12B is a front elevational view of the baseball platform of FIG. 12A from the perspective of a camera employed to create an illusion.

The inventive concept of hidden support means also has applications in illusions created in connection with conventional sports, i.e., sports that are not considered to be extreme sports. An example of the novel method applied to the sport of baseball is depicted in FIGS. 12A and 12B. A horizontal safety surface 20 surmounts a support means 48 that projects upwardly from base 12. This enables an individual to lie on safety surface 20 in a prostrate position as depicted in FIG. 12B and to extend an arm downwardly to conceal support means 48. Moreover, the wearing of a baseball glove further helps to conceal support means 48. The individual's body and clothing cooperate to conceal safety surface 20. Such a pose creates the illusion that the individual is flying through the air because safety surface 20 and support means 48 are well concealed. If a baseball glove is worn, the illusion shows a player diving for a baseball. If a soccer goalie's glove is worn, the illusion shows a goalie diving for a soccer ball. If no glove is worn, the same pose can create the illusion that a baseball player is sliding head first into a base. An individual could also sit on safety surface 20 and adopt a pose that would look like he or she were sliding feet first into a base. A second individual could pose in the photograph as an umpire, signaling that the apparent base runner is "safe" or "out." The presence of a second individual could be used to conceal another support means, such as a pedestal holding a base ball, so that it would appear that the ball is about to be caught in a glove or about to arrive at a base in time for a put out.

Figure 13A:
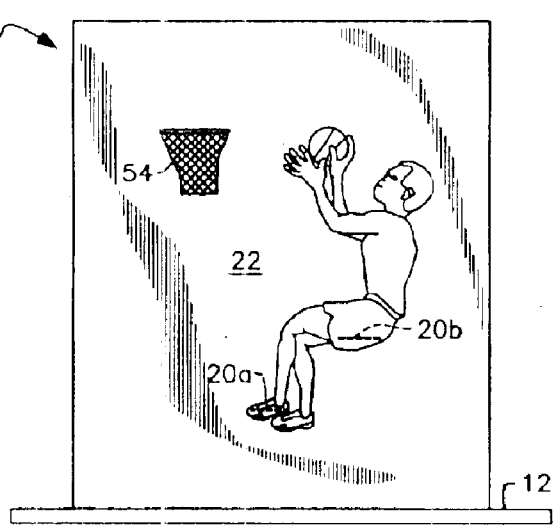
FIG. 13A is a front elevational view of the basketball platform of FIG. 13B from the perspective of a camera specifically positioned to create an illusion.
Figure 13B:
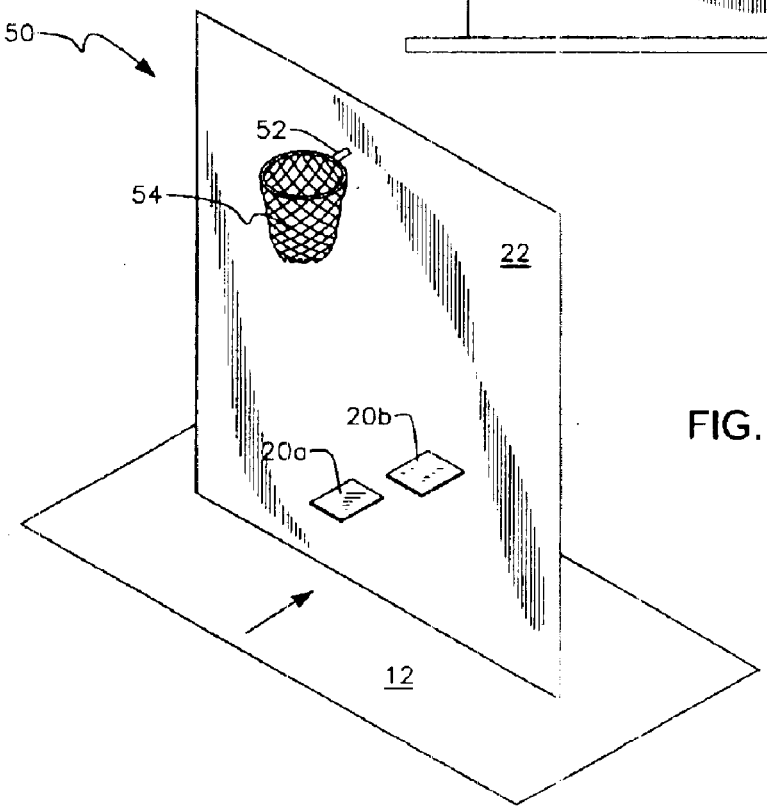
FIG. 13B is a perspective view of a basketball platform having a pair of safety surfaces upon which a subject may stand, sit, or otherwise pose to create an illusion.

Another example of employing the novel techniques in a conventional sport is depicted in FIGS. 13A and 13B. Basketball photographic platform 50 includes base 12 and upstanding support wall 22. Post 52 extends in cantilevered relation to upstanding support wall 22 and is concealed by hoop and net structure 54 that is mounted to the free end thereof. A pair of safety surfaces 20*a*, 20*b* are secured to upstanding support wall 22 in cantilevered relation thereto and are concealed when sat upon by an individual holding a basketball. A first foot of the individual may be positioned to conceal safety surface 20*a* and the second foot could be free for posing purposes. The individual may sit near the free end of safety surface 20*b* and his or her shorts are used to conceal the edge of said safety surface 20*b*. This embodiment may be modified by employing only one safety surface upon which the individual may stand, sit, or otherwise pose.

A football could replace net 54 and the individual could be seated atop safety surfaces 20*a*, 20*b* while wearing a football uniform, thereby creating the illusion that the individual was leaping high to catch a pass. A soccer ball could replace said net and the individual could wear a soccer uniform, creating the illusion that the individual is leaping high to head the ball. Positioning a baseball above the uppermost edge of upstanding support wall 22 would enable an individual dressed as a baseball player to appear to be leaping for a fly ball otherwise destined to leave the ballpark. The individual's arm could then conceal the post surmounted by the baseball. Alternatively, the ball could be attached to the glove either directly or with a concealed support.

By removing post 52 and net 54 or other prop secured to post 52, an illusion is created that the individual has leapt high into the air in connection with no particular sport. Again, as is the case with all of the photographic platforms of this invention, numerous unillustrated apparent action scenes may be created by exercising the imagination.

In a final example, depicted in FIGS. 14A and 14B, safety surface 20 extends horizontally between upstanding support walls 22*a*, 22*b* and is concealed by rope 56. This enables an individual safely standing on safety surface 20 to appear to be walking a tightrope. Due to the size of safety surface 20, the individual could perform a hand-stand, a one-legged crouch with one leg extended forwardly, and adopt many other poses which would seem to be difficult to perform on a tightrope. It is important that all of tightrope 56 appear in the scene, but since a tightrope must be supported at its opposite ends, this embodiment is a good example of a scene where it is acceptable to provide a support wall or other support surface in plain view with no attempt whatsoever at concealment or disguise. Undisguised support walls 22*a*, 22*b* are positioned at opposite ends of the tightrope and such undisguised support walls enhance the illusion that the apparent tightrope really is a tightrope when in fact it may not be. A real tightrope may be employed to conceal the safety surface, or an artifact that has been carefully crafted to look like a tightrope may be used. Moreover, one of the upstanding support walls may be eliminated so that safety surface 20 is mounted in cantilever relation to only one upstanding support wall.

There is clearly no limit to the possible apparent scenes that can be created using the novel method of providing concealed safety surfaces, unconcealed but disguised safety surfaces, concealed support surfaces, unconcealed but disguised support surfaces, and various items of sporting and non-sporting equipment which may be coupled to concealed and disguised safety surface or support means of differing kinds, all with appropriate camera positioning. As disclosed herein, safety surfaces and support means may be unconcealed but have the appearance of a surfboard leash, a snowboard leash, a rail, an upstanding post, a tailpipe, and so on. The support means may be concealed by an item of sporting equipment, by an individual, the clothing of the individual, a second individual, by a naturally occurring element in a scene being depicted, or it may be in full view but disguised as a naturally occurring element, and so on. A safety surface upon which an individual may stand, crouch, sit, lie, jump or otherwise pose may also be concealed by an item of sporting equipment, the individual, his or her clothing, a second individual, by a naturally occurring or typically-present element in the depicted scene, or it may be exposed to full view but disguised as a naturally appearing element, as an item of sporting or non-sporting equipment, and so on.

Moreover, an individual may interact with an item of non-sporting equipment or sporting equipment by standing, sitting, crouching, lying, jumping, or otherwise posing on or above the base of the photographic platform. Nor must the item of equipment be secured to a support means or a safety surface because many poses can be struck where an individual holds onto an item of equipment. Clearly, the number of possible poses is inexhaustible.

An individual or company desiring to serve the public by making the novel photographic platforms available may purchase or lease one or any number of such photographic platforms and position them in shopping malls, fair grounds, amusement parks, theme parks, festivals, outside stadiums before and after sporting events, and the like. Individuals desiring to be photographed in exciting action photos may safely pose atop the novel safety surfaces or upon those items of sporting equipment that are positioned such that they provide their own safety surface. As used herein, the term "photograph" includes any process that captures a still or a moving image, and includes action scenes of relatively short duration of the type capturable by a digital camera, a camcorder, and the like.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the genetic and specific features of the invention herein described, and all statements of the scope of the invention that, as a matter of language, might be said to fall therebetween.

Now that the invention has been described,

What is claimed is:

1. A method for creating an apparent action photograph, comprising the steps of:

providing a base that is generally flat;

positioning said base atop a stable, non-moving support surface;

preselecting an item of equipment;

providing a generally upstanding support means having a trailing end secured to said base and a leading end secured to said item of equipment so that said item of equipment is supported in vertically spaced apart relation to said base;

disguising the support function of said support means;

positioning an individual in interactive relation to said item of equipment in a preselected posture that includes standing, sitting, crouching, reclining, hand-standing, and jumping;

specifically positioning a camera so that said disguise of said support means is not compromised; and taking a photograph that includes the individual, entire item of equipment, and the entire support means;

whereby the entire item of equipment appears in said photograph as a complete item of equipment, there being no part thereof cropped by the photograph;

whereby the entire support means appears in said photograph, there being no part thereof cropped by the photograph; and whereby said entire item of equipment appears in said photograph to be unsupported.

2. The method of claim 1, further comprising the step of disposing the item of equipment in a generally horizontal plane so that said individual may safely be positioned in said preselected posture on said item of equipment without substantial risk of falling therefrom.

3. The method of claim 1, further comprising the steps of:

securing a safety surface to said item of equipment, said safety surface adapted to support said individual in said preselected posture;

positioning said item of equipment into concealing relation to said safety surface;

disposing said safety surface in a generally horizontal plane so that said individual may safely be positioned on said safety surface in said preselected posture without substantial risk of falling therefrom;

specifically positioning said camera so that said concealment of said safety surface is not compromised;

whereby said item of equipment need not be disposed in a generally horizontal plane.

4. The method of claim 1, wherein the step of disguising the support function of said support means includes the step of configuring said support means so that it appears to be a part of said item of equipment.

5. The method of claim 4, wherein the item of equipment is selected from a group of items consisting of a surfboard, a snowboard, a skateboard, a wakeboard, and a kiteboard.

6. The method of claim 4, wherein the step of disguising the support function of said support means further comprises the step of configuring said support means to have the appearance of a leash adapted to extend from an ankle of said individual.

7. The method of claim 1, wherein the step of disguising the support function of said support means includes the step of configuring said support means to have the appearance of a part of an environment within which said item of equipment is associated.

8. The method of claim 7, wherein the step of disguising the support function of said support means further comprises the step of configuring said support means to have the appearance of a ski pole.

9. The method of claim 7, wherein the step of disguising the support function of said support means further comprises the step of configuring the support means to have the appearance of a ski.

10. The method of claim 7, wherein the step of disguising the support function of said support means further comprises the step of configuring said support means to have the appearance of a rail.

11. The method of claim 7, wherein the step of disguising the support function of said support means further comprises the step of configuring said support means to have the appearance of an upstanding post.

12. The method of claim 1, wherein said item of equipment has a seat upon which said individual can sit and further has handle means to which said individual can hold so that said individual can sit on said item of equipment even if said item of equipment is positioned at a steep angle relative to a horizontal plane.

13. A method for creating an apparent action photograph, comprising the steps of:

providing a base that is generally flat;

positioning said base atop a stable, non-moving support surface;

preselecting an item of equipment;

providing a generally horizontal safety surface adapted to support an individual so that said individual may safely be positioned on said safety surface without substantial risk of falling therefrom;

providing a generally upstanding support means having a trailing end secured to said base and a leading end secured to said safety surface so that said safety surface is supported in vertically spaced apart relation to said base;

disguising the support function of said support means;

concealing said safety surface by attaching said item of equipment to said safety surface in concealing relation thereto;

positioning an individual on said safety surface in a preselected posture that is in interactive relation to said item of equipment to produce an illusion that said individual is using said item of equipment even though said item of equipment is unsupported by any apparent support means, specifically positioning a camera so that said concealment of said safety surface by said item of equipment is not compromised; and taking a photograph that includes the individual, the entire item of equipment, and the entire support means;

whereby the entire item of equipment appears in said photograph as a complete item of equipment, there being no part thereof cropped by the photograph;

whereby the entire support means appears in said photograph, there being no part thereof cropped by the photograph; and whereby said entire item of equipment and said individual appear in said photograph to be unsupported.

14. The method of claim 13, further comprising the steps of:

positioning said item of equipment at a insufficiently steep angle to prevent said individual from easily posing thereon; and posing said individual on said safety surface in a preselected posture that relates to the steeply angled orientation of said item of equipment.

15. The method of claim 13, wherein the step of disguising the support function of said support means includes the step of configuring said support means so that it appears to be a part of said item of equipment.

16. The method of claim 15, wherein the item of equipment is selected from a group of items consisting of a surfboard, a snowboard, a skateboard, a wakeboard, and a kiteboard.

17. The method of claim 16, wherein the step of disguising the support function of said support means further comprises the step of configuring said support means to have the appearance of a leash adapted to extend from an ankle of an individual positioned in said preselected posture relative to said item of equipment.

18. The method of claim 13, where the step of disguising the support function of said support means includes the step of configuring said support means to have the appearance of a part of an environment within which said item of equipment is associated.

19. The method of claim 13, wherein the step of disguising the support function of said support means further comprises the step of configuring said support means to have the appearance of a ski pole.

20. The method of claim 13, wherein the step of disguising the support function of said support means further comprises the step of configuring the support means to have the appear of a ski.

21. A method for creating an apparent action photograph, comprising the steps of:

providing a base that is generally flat;

positioning said base atop a stable, non-moving support surface;

mounting an upstanding support means to said base;

disguising the support function of said upstanding support means;

preselecting an item of equipment;

mounting a trailing end of a support member to said upstanding support means and a leading end of said support member to said item of equipment;

disguising the support function of said support member;

positioning an individual on said item of equipment in a preselected posture that is in interactive relation to said item of equipment to produce an illusion that said individual is using said item of equipment even though said item of equipment is unsupported by any apparent support means;

specifically positioning a camera so that said disguise of said upstanding support means and said support member is not compromised; and taking a photograph that in includes the individual, the entire item of equipment, the entire upstanding support means and the entire support member;

whereby thee item of equipment appears in said photograph as a complete item of equipment, them being no part thereof cropped by the photograph;

whereby the entire upstanding support means appears in said photograph, there being no part thereof cropped by the photograph;

whereby the entire support member appears in said photograph there being no part thereof cropped by the photograph; and whereby said entire item of equipment and said individual appear in said photograph to be spaced apart from yet unsupported by said base, said entire upstanding support means, and said entire support member.

22. The method of claim 21, further comprising the step of disposing the item of equipment in a generally horizontal plane so that said individual may safely be positioned in said preselected posture on said item of equipment without substantial risk of falling therefrom.

23. The method of claim 21, further comprising the steps of:

securing a flat safety surface to said item of equipment in coplanar relationship therewith, said flat safety surface adapted to support an individual; and concealing said flat safety surface by securing said item of equipment thereto in concealing relationship therewith.

24. The method of claim 21, wherein the step of disguising the support function of said support member includes the step of configuring said support member so that it appears to be a part of said item of equipment.

25. The method of claim 21, wherein said item of equipment has a seat upon which said individual can sit and further has handle means to which said individual can hold so that said individual can sit on said item of equipment even if said item of equipment is positioned at a steep angle relative to a horizontal plane.

26. The method of claim 25, wherein the item of equipment is a two-wheeled vehicle and wherein the support member is disguised as a fender of said two-wheeled vehicle.

27. The method of claim 25, wherein the item of equipment is an automobile and wherein the support means is disguised as a tailpipe of said automobile.

28. The method of claim 21, wherein the step of disguising the support function of said upstanding support means includes the step of configuring said support means to have the appearance of a part of an environment within which said item of equipment is associated.

29. The method of claim 21, wherein the step of disguising said support means further comprises the step of configuring said upstanding support means to have the appearance of a hand rail.

30. A method for creating an apparent action photograph, comprising the steps of:

providing a base that is generally flat;

positioning said base atop a stable, non-moving support surface;

mounting an upstanding support means to said base;

concealing the support function of said upstanding support means;

preselecting an item of equipment;

providing a safety surface;

mounting a trailing end of a support member to said upstanding support means and a leading end of said support member to said safety surface;

mounting said item of equipment to said safety surface in concealing relation to said safety surface;

positioning an individual on said safety surface in a projected pose in interactive relation to said item of equipment to produce an illusion that said individual is using said item of equipment even though said item of equipment is unsupported by any apparent support means; and taking a photograph that includes the individual and the entire item of equipment;

whereby the entire item of equipment appears in said photograph as a complete item of equipment, there being no part thereof cropped by the photograph, and whereby said entire item of equipment and said individual appear in said photograph to be unsupported.

31. A method for creating an apparent action photograph comprising the steps of:

providing a base that is generally flat;

positioning said base atop a stable, non-moving support surface;

mounting an upstanding support means to said base;

disguising the support function of said upstanding support means;

preselecting an item of equipment;

providing a safety surface;

mounting a trailing end of a support member to said upstanding support means and a leading end of said support member to said safety surface;

mounting said item of equipment to said safety surface in concealing relation to said safety surface;

disguising the support function of said support means;

positioning an individual on said safety surface in a preselected pose in interactive relation to said item of equipment to produce an illusion that said individual is using said item of equipment even though said item of equipment is unsupported by any apparent support means;

specifically positioning a camera so that said disguise of said support means is not compromised; and taking a photograph that includes the individual, entire item of equipment, and the entire upstanding support means;

whereby the entire item of equipment appears in said photograph as a complete item of equipment, there being no part thereof cropped by the photograph;

whereby the entire upstanding support means appears in said photograph, there being no part thereof cropped by the photograph; and whereby said entire item of equipment and said individual appear in said photograph to be unsupported.

32. The method of claim 30, wherein the step of mounting said item of equipment to said safety surface in concealing relation to said safety surface further includes the step of mounting said item of equipment to said safety surface in concealing relation to said support member.

33. The method of claim 30, further comprising the steps of disposing said safety surface in a generally horizontal plane so that said individual may safely be positioned in said preselected posture on said safety surface without substantial risk of falling therefrom.

34. The method of claim 30, wherein the step of disguising the support function of said support means includes the step of configuring said support means so that it appears to be a part of said item of equipment.

35. The method of claim 30, wherein the item of equipment is selected from a group of items consisting of a surfboard, a snowboard, a skateboard a wakeboard, and a kiteboard.

36. The method of claim 30, wherein the step of disguising the support function of said support means further comprises the step of configuring said support means to have the appearance of a leash adapted to extend from an ankle of an individual positioned atop said relatively flat item.

37. The method of claim 30, wherein the step of disguising the support function of said support means includes the step of configuring said support means to have the appearance of a part of an environment within which said item of equipment is associated.

38. The method of claim 30, wherein the step of disguising the support function of said support means further comprises the step of configuring said support means to have the appearance of a rail.

39. The method of claim 30, wherein the step of disguising said support function of said support means further comprises the step of configuring said support means to have the appearance of an upstanding post.

40. A method for creating an apparent action photographs, comprising the steps of:

providing a base that is generally flat;

positioning said base atop a stable, non-moving support surface;

mounting an upstanding support means to said base;

preselecting an item of equipment having at least two parts;

providing a safety surface adapted to support an individual thereon;

mounting said safety surface in cantilevered relation to said upstanding support means;

disguising the support function of said upstanding support means;

mounting a first part of said item of equipment to said safety surface in non-coplanar relationship therewith;

concealing said safety surface by positioning a second part of said item of equipment in concealing relation thereto;

specifically positioning a camera so that said disguise of said support means and the concealment of said safety surface is not compromised; and taking a photograph that includes the individual, the entire first and second parts of said item of equipment, and the entire support means;

whereby the entire first and second parts of said item of equipment appear in said photograph as a complete item of equipment, there being no part thereof cropped by the photograph;

whereby the entire support means appears in said photograph, there being no part thereof cropped by the photograph; and whereby said entire first and second parts of said item of equipment and said individual appear in said photograph to be unsupported.

41. The method of claim 40, further comprising the step of disposing the safety surface in a generally horizontal plane so that said individual may assume said preselected posture relative to said safe surface without substantial risk of falling therefrom.

42. The method of claim 40, where the first item of equipment is a pair of skis.

43. The method of claim 40, wherein the second item of equipment is a ski pole.

44. The method of claim 40, wherein the step of concealing said safety surface includes the step of disguising said concealment means to have the appearance of a part of an environment within which said item of equipment is associated.

45. A method for creating an apparent action photograph, comprising the steps of:

providing a base that is generally flat;

positioning said base atop a stable, non-moving support surface;

mounting an upstanding support means to said base;

preselecting an item of equipment;

providing a safety surface adapted to support an individual thereon;

mounting said safety surface in cantilevered relation to said upstanding support means;

disguising the support function of said upstanding support means;

said item of equipment being held by said individual in non-coplanar relationship with said safety surface;

concealing said safety surface with said item of equipment;

specifically positioning a camera so that said holding of said item of equipment and said concealment of said safety surface by said item of equipment is not compromised; and taking a photograph that includes the individual, and said entire item of equipment;

whereby the entire item of equipment appears in said photograph as a complete item of equipment, there being no part thereof cropped by the photograph;

whereby the entire upstanding support means appears in said photograph, there being no part thereof cropped by the photograph; and whereby said entire item of equipment and said individual appear in said photograph to be unsupported.

46. The method of claim 45, further comprising the step of disposing the safety surface in a generally horizontal plane so that said individual may safely be positioned on said safety surface in said preselected posture without substantial risk of falling therefrom.

47. The method of claim 45, wherein the first item of equipment is a pair of skis and wherein the second item of equipment is a ski pole.

48. A method for creating an apparent action photograph, comprising the steps of:

providing a base that is generally flat;

positioning said base atop a stable, non-moving support surface;

mounting at least one upstanding post to said base;

mounting at least one rail in surmounting relation to said at least one upstanding post;

preselecting an item of equipment adapted to support an individual thereon;

providing a flat safety surface;

mounting said flat safety surface in cantilevered relation to said at least one rail so that said at least one rail conceals a fist edge of said flat safety surface;

mounting a first item of equipment to a free end of said flat safety surface;

said first item of equipment concealing a second edge of said flat safety surface;

specifically positioning a camera in a first position so that at least one rail conceals said first edge of said flat safety surface;

specifically positioning said camera in a second position so that said first item of equipment conceals said second edge of said flat safety surface;

taking a first photograph that includes said individual and said entire first item of equipment from said first position;

taking a second photograph that includes said individual and said entire first item of equipment from said second position;

whereby said first item of equipment appears in said first and second photographs as a complete item of equipment, there being no part thereof cropped by the photograph;

whereby said entire first item of equipment and said individual appear in said photograph to be unsupported.

49. The method of claim 48, further comprising the step of disposing the safety surface in a generally horizontal plane so that said individual may safely be positioned on said safety surface in said preselected posture without substantial risk of falling therefrom.

50. The method of claim 48, wherein said item of equipment has a seat upon which said individual can sit and further has handle means to which said individual can hold so that said individual can sit on said item of equipment even if said item of equipment is positioned at a steep angle relative to a horizontal plane.

51. A method for creating an apparent action photograph, comprising the steps of;

providing a base that is generally flat;

positioning said base atop a stable, non-moving support surface mounting an upstanding support means to said base;

disguising the function of said support means;

preselecting an item of equipment adapted to support an individual thereon;

mounting a support member to sad upstanding support means in substantially parallel relation to said base;

mounting said item of equipment to a free end of said support means;

specifically positioning a camera so that said item of equipment conceals said support means; and taking a photograph that include said individual, said entire upstanding support means, and said entire item of equipment;

whereby said entire item of equipment appears in said photograph as a complete item of equipment, there being no part thereof cropped by the photograph;

whereby said entire upstanding support means appears in said photograph, there being no cropping thereof by said photograph;

whereby said entire item of equipment and said individual appear in said photograph to be unsupported.

52. The method of claim 51, wherein said support means is a post.

53. The method of claim 51, wherein said support means is a safety surface.

54. The method of claim 51, wherein said item of equipment has a seat upon which said individual can sit and further has handle means to which said individual can hold so that said individual can sit on said item of equipment even if said item of equipment is positioned at a steep angle relative to a horizontal plane.

55. A method for creating an apparent action photograph, comprising the steps of:

providing a base that is generally flat;

positioning said base atop a stable, non-moving support surface;

preselecting an item of equipment adapted to support an individual thereon;

mounting said item of equipment to said base at an angle thereto so that only a small part of said item of equipment is in abutting relation to said base;

performing said mounting step by using a strong mounting means that is concealed by a material that is not strong so that an observer is unaware of the strong mounting means and unaware of the support function of the mounting means;

taking a photograph that include said individual, said entire mounting means, and said entire item of equipment;

whereby said entire item of equipment appears in said photograph as a complete item of equipment, there being no part thereof cropped by the photograph;

whereby said entire mounting means appears in said photograph, there being no part thereof cropped by said photograph; and whereby said entire item of equipment and said individual appear in said photograph to be unsupported.

56. A method for creating an apparent action photograph, comprising the steps of:

providing a base that is generally flat;

positioning said base atop a stable, non-moving support surface;

providing a substantially horizontal safety surface;

providing a support means having a trailing end secured to said base and a leading end secured to said safety surface so that said safety surface is supported in spaced apart relation to said base;

positioning an individual on said safety surface such that said individual conceals said support means and said safety surface;

specifically positioning a camera so that said concealment of said support means and safety surface is not compromised; and taking a photograph of the individual;

whereby said individual appeal in said photograph to be positioned above said base in the absence of any support means.

57. The method of claim 56, further comprising the step of:

positioning said individual in a supine posture atop said safety surface;

positioning an arm of said individual in concealing relation to said support means.

58. A method for creating an apparent action photograph, comprising the steps of:

providing a base that is generally flat;

positioning said base atop a stable, non-moving support surface;

mounting an upstanding support wall to said base;

preselecting an item of equipment;

mounting a trailing end of a support means to said upstanding support wall and a leading end of said support means to said item of equipment so that said item of equipment conceals said support means;

mounting a first safety surface in cantilevered relation to said upstanding support wall in a first preselected location;

positioning an individual on said fist safety surface so that said individual and the clothing of said individual conceal said first safety surface;

posing said individual in interactive relation to said item of equipment;

specifically positioning a camera so that said concealment of said support means is not compromised; and taking a photograph that includes the individual and the entire item of equipment;

whereby the entire item of equipment appears in said photograph as a complete item of equipment, there being no part thereof cropped by the photograph; and whereby said individual appears in said photograph to be positioned above said base in spaced relation thereto in the absence of any support, thereby creating an illusion that said individual has leapt to said position above said base.

59. The method of claim 58, further comprising the steps of:

mounting a second safety surface in cantilevered relation to said upstanding support wall in a second preselected location;

positioning said individual in seated relation to said first safety surface so that said individual and the clothing of said individual conceals said first safety surface;

positioning a first foot of said individual atop said second safety surface;

positioning a second foot of said individual in concealing relation to said second safety surface;

posing said individual in interactive relation to said item of equipment;

specifically positioning a camera so that said concealment of said second safety surface is not compromised; and taking a photograph of the individual and the item of equipment;

whereby the item of equipment appears in said photograph as a complete item of equipment, there being no part thereof cropped by the photograph; and whereby said individual appears in said photograph to be positioned above said base in spaced relation thereto in the absence of any support, thereby creating an illusion that said individual has leapt to said position above said base.

60. A method for creating an apparent action photograph, comprising the steps of:

providing a base that is generally flat;

positioning said base atop a stable, non-moving support surface;

mounting a first upstanding support means to said base;

mounting a second upstanding support means to said base in spaced apart relation to said first upstanding support means;

mounting a safety surface between said first and second upstanding support means in a first preselected location;

preselecting an item of equipment;

concealing said safety surface by mounting said preselected item of equipment to an edge of said safety surface;

positioning an individual on said first safety surface in interactive relation to said item of equipment;

specifically positioning a camera so that said concealment of said safety surface is not compromised; and taking a photograph that includes the individual, the entire item of equipment, the entire first upstanding support means, and the entire second upstanding support means;

whereby the entire item of equipment appears in said photograph as a complete item of equipment, there being no part thereof cropped by the photograph;

whereby the entire first support means and the entire second support means appear in said photograph, there being no part thereof cropped by the photograph; and whereby said individual appears in said photograph to be positioned atop said entire item of equipment in spaced relation above said base.

61. The method of claim 60, wherein said item of equipment is a tightrope.

62. A method for creating an apparent action photograph, comprising the steps of:

providing a base that is generally flat;

positioning said base atop a stable, non-moving support surface;

mounting an upstanding support means to said base;

disguising the function of said upstanding support means;

preselecting an item of equipment;

providing a safety surface;

mounting said safety surface to said upstanding support means;

mounting said item of equipment to said safety surface in concealing relation to said safety surface;

further mounting said item of equipment to said safety surface in concealing relation to said support means;

positioning an individual on said safety surface in interactive relation to said item of equipment to produce an illusion that said individual is using said item of equipment even though said item of equipment is unsupported by any apparent support means;

specifically positioning a camera so that said disguise of said support means is not compromised; and taking a photograph that includes the individual, the entire item of equipment, and the entire upstanding support means;

whereby the entire item of equipment in said photograph as a complete item of equipment, there being no part thereof cropped by the photograph;

whereby the entire upstanding support means appears in said photograph, there being no part thereof cropped by said photograph; and whereby said entire item of equipment and said individual appear in said photograph to be unsupported.

* * * * *